US010378732B2

(12) United States Patent
Gordin et al.

(10) Patent No.: US 10,378,732 B2
(45) Date of Patent: Aug. 13, 2019

(54) APPARATUS, METHOD, AND SYSTEM FOR PRECISE LED LIGHTING

(71) Applicant: Musco Corporation, Oskaloosa, IA (US)

(72) Inventors: Myron Gordin, Oskaloosa, IA (US); Luke C. McKee, Oskaloosa, IA (US); Chris P. Lickiss, Newton, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 16/000,567

(22) Filed: Jun. 5, 2018

(65) Prior Publication Data

US 2018/0347787 A1 Dec. 6, 2018

Related U.S. Application Data

(60) Provisional application No. 62/515,832, filed on Jun. 6, 2017.

(51) Int. Cl.
*F21V 14/04* (2006.01)
*F21V 17/02* (2006.01)
(Continued)

(52) U.S. Cl.
CPC ..... *F21V 14/04* (2013.01); *F21K 9/65* (2016.08); *F21K 9/68* (2016.08); *F21V 17/02* (2013.01)

(58) Field of Classification Search
CPC . F21V 14/04; F21V 17/02; F21K 9/65; F21K 9/68
See application file for complete search history.

(56) References Cited

U.S. PATENT DOCUMENTS 1,176,475 A 3/1916 McPherson
1,560,948 A 3/1924 Smothers
(Continued)

FOREIGN PATENT DOCUMENTS

EP 1424363 B1 2/2007

OTHER PUBLICATIONS

Musco Corporation, PCT/US2018/036111 filed Jun. 5, 2018, "The International Search Report and the Written Opinion of the International Searching Authority", dated Sep. 19, 2018.
(Continued)

*Primary Examiner* — Tracie Y Green
(74) *Attorney, Agent, or Firm* — McKee, Voorhees & Sease, PLC

(57) ABSTRACT

Lighting applications which are particularly difficult to light because of "non-standard" target area characteristics or the like would benefit from advancements in lighting design. That being said, conventional wisdom in lighting design has reached a point of diminishing returns in terms of beam control. Envisioned is an LED lighting system designed for precision lighting insomuch that—as compared to state-of-the-art LED lighting fixtures—sharpness of cutoff is improved while in at least some cases simultaneously allowing a steeper cutoff without undesirable beam shift. Furthermore, overall beam dimensions can be tailored fixture-to-fixture for an application without replacing an entire optic system or designing an entirely new fixture, and control of intensity distribution is improved (e.g., by avoiding striations at the edge of beam patterns). Said envisioned LED lighting system employs a number of materials not used in conventional LED lighting systems in novel ways to achieve the aforementioned.

18 Claims, 34 Drawing Sheets

(51) Int. Cl.
*F21K 9/65* (2016.01)
*F21K 9/68* (2016.01)

(56) References Cited

U.S. PATENT DOCUMENTS

| | | | |
|---|---|---|---|
| 1,751,111 | A | 8/1928 | Steele et al. |
| 4,337,506 | A | 6/1982 | Terada |
| 4,388,678 | A | 6/1983 | Turner |
| 5,647,661 | A | 7/1997 | Gordin |
| 5,887,969 | A | 3/1999 | Gordin |
| 5,906,425 | A | 5/1999 | Gordin et al. |
| 6,220,726 | B1 | 4/2001 | Gordin |
| 7,500,764 | B2 | 3/2009 | Gordin |
| 7,703,951 | B2 | 4/2010 | Piepgras et al. |
| 7,828,465 | B2 | 11/2010 | Roberge et al. |
| 8,789,967 | B2 | 7/2014 | Gordin et al. |
| 2008/0278941 | A1 | 11/2008 | Logan et al. |
| 2011/0149582 | A1 | 6/2011 | McKee |
| 2011/0227487 | A1 | 9/2011 | Nichol et al. |
| 2013/0250556 | A1 | 9/2013 | Gordin et al. |
| 2014/0340889 | A1 | 11/2014 | Gordin |

OTHER PUBLICATIONS

Abrisa Technologies, Application Note: First Surface Mirrors, Jan. 28, 2016.

Detail A

Detail B

Detail C

Detail D

APPARATUS, METHOD, AND SYSTEM FOR PRECISE LED LIGHTING

CROSS-REFERENCE TO RELATED APPLICATIONS

This application claims priority under 35 U.S.C. § 119 to provisional U.S. application Ser. No. 62/515,832, filed Jun. 6, 2017, hereby incorporated by reference in its entirety.

I. TECHNICAL FIELD OF THE INVENTION

The present invention generally relates to improvements in LED lighting system design to provide more precise beam control in one or more planes. More specifically, the present invention relates to providing sharper cutoff, greater flexibility in providing tailored beam dimensions, and better control of intensity distribution as compared to state-of-the-art LED lighting fixtures through improved design of light directing (e.g., lens) and/or light redirecting (e.g., reflector) devices in multi-part components.

II. BACKGROUND OF THE INVENTION

Within the art of lighting design there are certain applications which are known to be much more demanding than others; for example, sports and roadway. These more demanding applications typically require, as compared to general purpose lighting, sharper cutoff (i.e., a smaller angle over which light transitions from its maximum candela value (or photometric center) to nearly imperceptible) so to place light on the target area but cut it off before it reaches the stands and produces glare for spectators, as one example. Unfortunately, conventional means of cutting off light such as pivoting or angling of external visors, if done at too steep an angle can have the negative effect of shifting maximum candela of the beam. These more demanding lighting applications require complicated lighting designs wherein the target area is mapped out in a virtual space in lighting design software and each virtual fixture is generated and carefully aimed to a point on the virtual target area so to meticulously build up a virtual lighting design which, in practice, corresponds to an actual lighting design wherein, ideally, a layering of beams from actual lighting fixtures results in a composite beam having the required intensity and uniformity for the application; see, for example, U.S. Pat. No. 7,500,764 incorporated by reference herein in its entirety for additional discussion. The success of the actual lighting design meeting required intensity and uniformity is incumbent upon photometry in the lighting design software matching the light produced by the actual lighting fixtures. Once actual lighting fixtures are installed at the actual target area and cutoff is set using conventional means, candela shift can occur. For example, not all lighting design software is equipped to recalculate beam distribution at high cutoff angles—it is only once installed that fixtures aimed at high cutoff angles will show a detrimental candela shift. Site changes (e.g., trees, new structures) not originally accounted for may necessitate different mounting heights and in situ adjustment of cutoff angles—which could cause candela shift. In practice, candela shift of even one lighting fixture can make an entire lighting design non-compliant for the highest levels of sports.

Of course, there are state-of-the-art lighting fixtures that address many of the needs of demanding lighting applications and to some degree address candela shift; see, for example, U.S. Pat. Nos. 5,887,969 and 8,789,967 incorporated by reference herein in their entirety. However, even within demanding lighting applications like sports and roadway there are still areas having needs unmet or under-met; irregular racetracks and five-pole baseball layouts are two possible examples. In these niche areas of what is referred to as high demand lighting applications circumstances align (e.g., long setbacks with shallow seating, flat tracks, roofless vehicles) such that conventional lighting is inadequate—cutoff is not sharp enough, the beam is not smooth enough, etc.—even when using some of the more advanced lighting technologies discussed in U.S. Pat. Nos. 5,887,969 and 8,789,967. Merely adding additional lenses, visors, baffles, light absorbing material, etc. to a lighting fixture using conventional materials and conventional means—as is standard practice in the industry—does not adequately address the lighting needs of high demand lighting applications; conventional wisdom adds weight and cost, reduces transmission efficiency and light that is useful for the application, and still cannot provide the needed beam control. What is needed is a different approach to lighting design, with commensurate changes to light directing and light redirecting devices.

Thus, there is room for improvement in the art.

III. SUMMARY OF THE INVENTION

Lighting applications including those which are particularly difficult to light because of "non-standard" target area characteristics or the like would benefit from advancements in lighting design. Conventional wisdom in lighting design has reached a point of diminishing returns in terms of beam control and cutoff—in some cases even causing detrimental effects such as candela shift—and so said advancements should come from a place other than conventional wisdom.

It is therefore a principle object, feature, advantage, or aspect of the present invention to improve over the state of the art and/or address problems, issues, or deficiencies in the art.

Envisioned is an LED lighting system designed for precision lighting insomuch that—as compared to state-of-the-art LED lighting fixtures—sharpness of cutoff is improved while in at least some cases simultaneously allowing a steeper cutoff (i.e., smaller cutoff angle) without undesirable beam shift. Furthermore, overall beam dimensions can be tailored fixture-to-fixture for an application without replacing an entire optic system or designing an entirely new fixture, and control of intensity distribution is improved (e.g., by avoiding striations at the edge of beam patterns). Said envisioned LED lighting system employs a number of materials not used in conventional LED lighting systems in novel ways to achieve the aforementioned.

Further objects, features, advantages, or aspects of the present invention may include one or more of the following:

a. a multi-part visoring system to provide sharper and/or steeper cutoff;
b. a multi-part optic system to provide tailored beam dimensions; and
c. a multi-part differential reflection system to provide improved intensity distribution at or near beam pattern edges and/or across a beam pattern.

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

FIGS. 1-10 illustrate a first embodiment according to aspects of the present invention; note that for clarity all electrical connections and most fastening devices have been omitted. FIG. 1 illustrates a perspective view of this first embodiment, FIG. 2 illustrates FIG. 1 with external visor components partially exploded so to illustrate details of the multi-part visoring system and the multi-part differential reflection system, and FIG. 3 illustrates FIG. 1 with housing and internal housing components partially exploded so to illustrate details of the multi-part optic system. FIG. 4 illustrates a front view of FIG. 1, FIG. 5 illustrates a back view of FIG. 1, FIG. 6 illustrates a top view of FIG. 1, FIG. 7 illustrates a bottom view of FIG. 1, FIG. 8 is a left side view of FIG. 1, FIG. 9 is a right side view of FIG. 1, and FIG. 10 illustrates in enlarged view Detail A of FIG. 4.

FIGS. 11 and 12 illustrate a second embodiment in which the first embodiment of FIGS. 1-10 is modified such that a second portion of the multi-part visoring system is located some distance away from and not structurally connected to a first portion of the multi-part visoring system; note that the second portion is not to scale relative the first portion. FIG. 11 illustrates a perspective view of FIG. 1 as modified according to aspects of this second embodiment, and FIG. 12 illustrates in enlarged view Detail B of FIG. 11.

FIGS. 13A-C illustrate the second embodiment of FIGS. 11 and 12 as applied to a high demand lighting application; here, a long setback, sharp cutoff turn at a race track. FIG. 13A illustrates general dimensions of the various lighting considerations, FIG. 13B diagrammatically illustrates vertical beam cutoff from the lighting fixture, and FIG. 13C diagrammatically illustrates horizontal beam cutoff from the lighting fixture to facilitate lighting upstream and/or downstream of a driver on said race track.

FIGS. 14-22 illustrate a third embodiment according to aspects of the present invention; note that for clarity all electrical connections and most fastening devices have been omitted. FIG. 14 illustrates a perspective view of this third embodiment, FIG. 15 illustrates FIG. 14 with external visor components partially exploded so to illustrate details of the multi-part visoring system and the multi-part differential reflection system, and FIG. 16 illustrates FIG. 14 with housing and internal housing components partially exploded so to illustrate details of the multi-part optic system. FIG. 17 illustrates a front view of FIG. 14, FIG. 18 illustrates a back view of FIG. 14, FIG. 19 illustrates a top view of FIG. 14, FIG. 20 illustrates a bottom view of FIG. 14, FIG. 21 is a left side view of FIG. 14, and FIG. 22 is a right side view of FIG. 14.

FIGS. 23 and 24 illustrate a fourth embodiment in which the third embodiment of FIGS. 14-22 is modified such that a second portion of the multi-part visoring system is located some distance away from and not structurally connected to a first portion of the multi-part visoring system; note that the second portion is not to scale relative the first portion. FIG. 23 illustrates a perspective view of FIG. 14 as modified according to aspects of this fourth embodiment, and FIG. 24 illustrates in enlarged view Detail C of FIG. 23.

FIG. 25 illustrates the fourth embodiment of FIGS. 23 and 24 as applied to a high demand lighting application; here, a baseball field with a five-pole layout. Here, hatching indicate areas lit by fixture 1000, and non-hatched areas are not lit by fixture 1000 (but would be lit by fixtures at other pole locations not in the line-of-sight of batter 112).

FIGS. 26A-E illustrate various views of the multi-part optic system of Embodiments 1-4 of FIGS. 1-25. FIG. 26A illustrates an enlarged side view of the LEDs (on a board), first optic portion, and second optic portion as assembled and in isolation. FIG. 26B illustrates a bottom view of the first optic portion, FIG. 26C illustrates a top view of the first optic portion, FIG. 26D illustrates a bottom view of the second optic portion, and FIG. 26E illustrates a top view of the second optic portion.

FIGS. 27A and B illustrate the underlying methodology of aspects of the present invention. FIG. 27A illustrates a method of lighting a high demand lighting application with any of embodiments 1-4, and FIG. 27B illustrates a method of aiming the desired style and configuration of multi-part visor in accordance with the method of FIG. 27A.

V. DETAILED DESCRIPTION OF EXEMPLARY EMBODIMENTS

A. Overview

Figure 1:
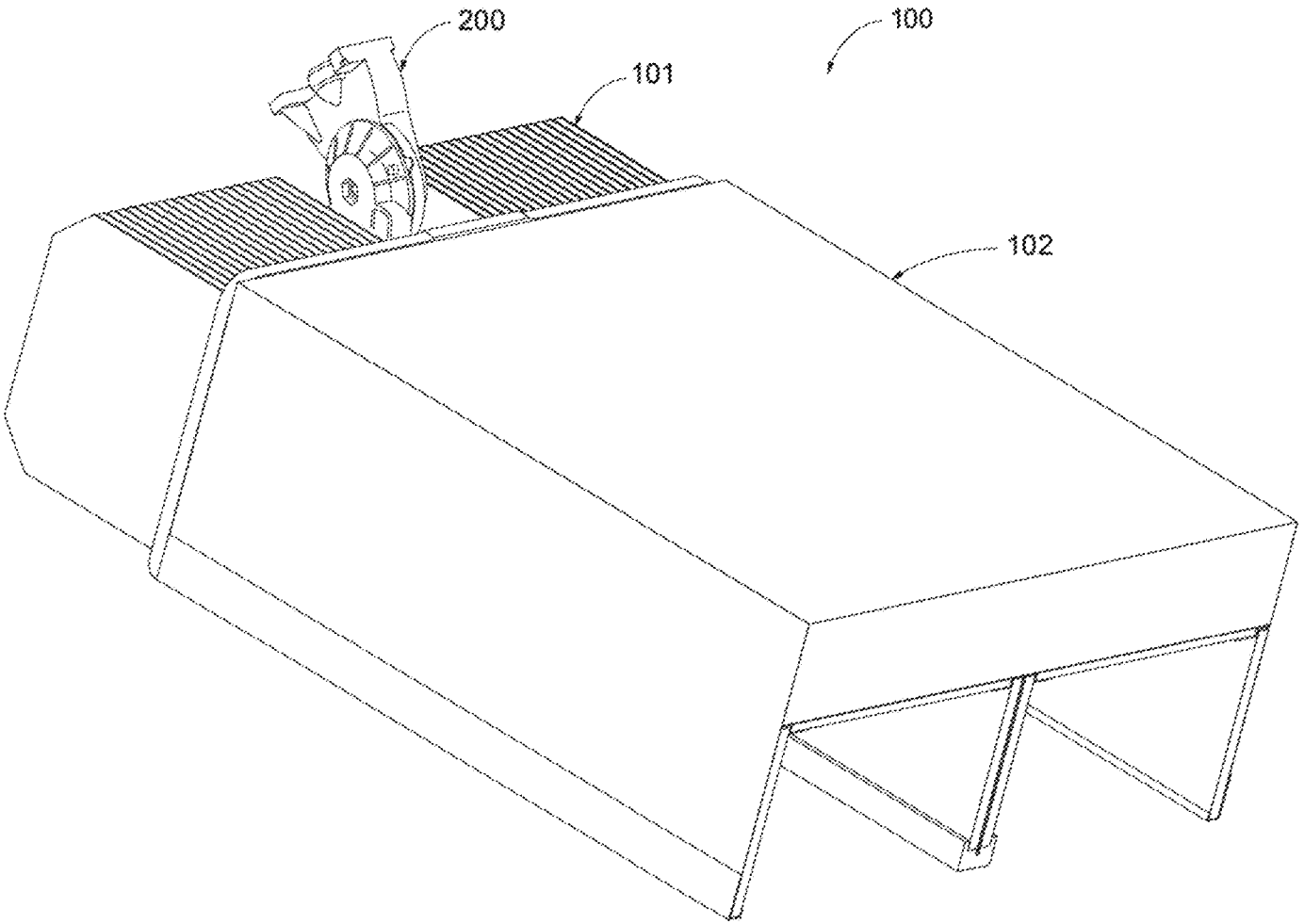

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, reference has been given herein to "fixture(s)" or "lighting fixture(s)"; it is important to note that these terms are often used interchangeably with "luminaire(s)" and that neither is intended to purport any limitations (e.g., operating conditions, power requirements) not stated herein. Also, regarding terminology, reference is given herein to "light directing" and "light redirecting" devices; the former is intended to mean any device or means which primarily directs light, and the latter is intended to mean any device or means which primarily redirects light, though either could have an element of the other. For example, most secondary lenses for LEDs (i.e., not the integral primary lens/encapsulant on the die) are considered light directing devices since they primarily collimate and direct light, even though at some extreme angles light is redirected back into the lens and lost. Other non-exhaustive examples of light directing devices might include filters or structural components of the system that provide orientation/pivoting (e.g., adjustable armatures); non-exhaustive examples of light redirecting devices might include reflectors, visors, light absorbing materials, or diffusers. Finally, regarding terminology reference is given herein to "beam(s)" and "composite beam(s)"; it is important to note that a beam (whether composite or not) has a size, shape, color, and intensity (sometimes partially or wholly referred to as a "pattern" or "output"), and that these can differ from other beams and not depart from aspects of the present invention. Further, the same lighting fixture may produce both a beam and composite beam, given the context of the situation. For example, any lighting fixture employing more than one LED is emitting a composite beam; however, a racetrack or other high demand lighting application may employ dozens of lighting fixtures each employing a plurality of LEDs. In this sense, and in the context of the overall lighting design, each lighting fixture produces a beam that is layered, juxtaposed, or otherwise considered with the beams from all other fixtures relative the target area to produce a composite beam (or put otherwise, the overall beam pattern). Thus, while the precise number and layout of light sources within a fixture will most certainly impact the beam properties of the light emitted from that fixture, aspects of the present invention are not restricted to a beam, or a composite beam, or any particular configuration of light sources, fixtures, and beams.

The exemplary embodiments envision an LED lighting system designed for precision lighting for, most often, high demand lighting applications (as opposed to, for example, general purpose lighting applications); here the precision of the lighting is defined in terms of sharpness and/or steepness of cutoff, degree to which beam dimensions can be tailored, and ability to improve intensity distribution at or near beam pattern edges and/or across a beam pattern. Central to each of the embodiments are three components; namely, the multi-part visoring system, the multi-part optic system, and the multi-part differential reflection system. One, two, or all of the three components may be used and/or combined in different configurations to provide varying degrees of precision lighting for the aforementioned high demand and/or difficult-to-light lighting applications; though, of course, aspects according to the present invention could be applied to other kinds of lighting applications (e.g., general purpose). A description of examples of each component is as follows.

1. Multi-Part Visoring System

Figure 13A:
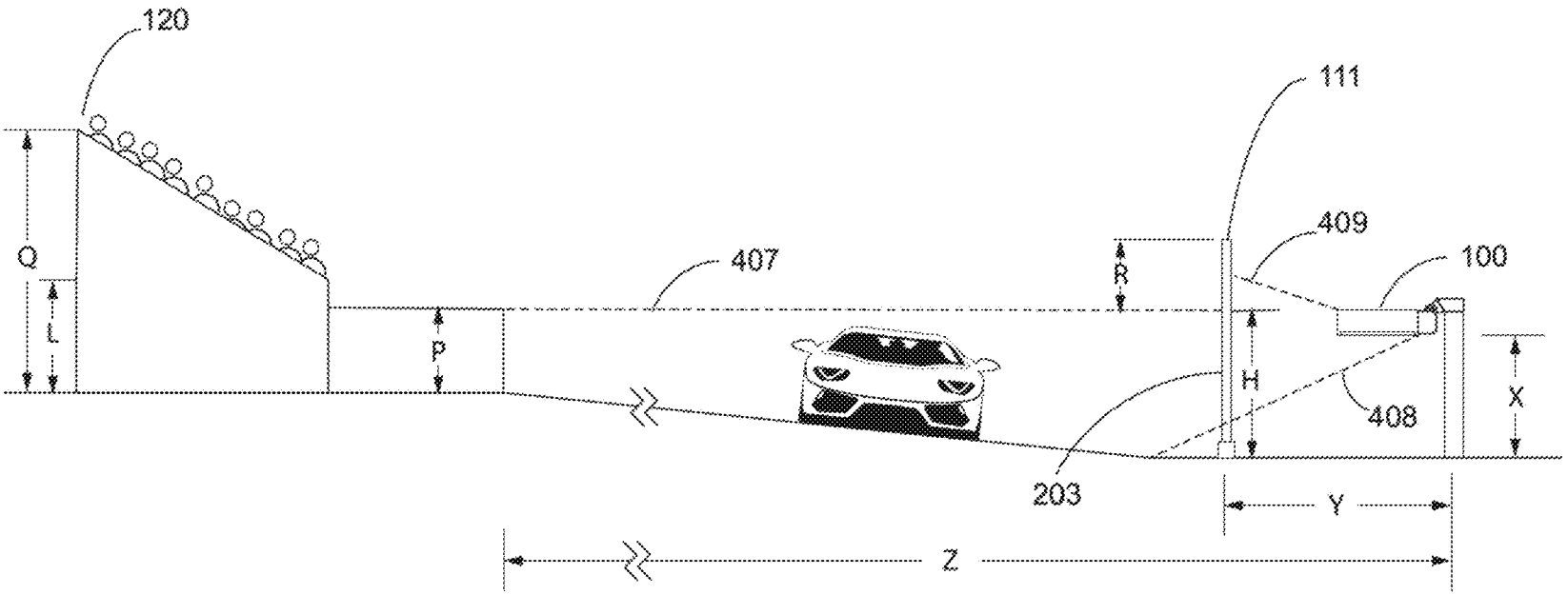

As stated, the primary purpose of the multi-part visoring system is to provide sharper and/or steeper cutoff as compared to state-of-the-art LED lighting systems. The multi-part visoring system generally comprises a first stage of light redirection combined with a second stage of light absorption to provide sharper cutoff in a desired plane with minimal loss of light; for the aforementioned examples of racetrack lighting (FIG. 13A) and five-pole baseball lighting (FIG. 25) the desired plane is the vertical plane (see reference nos. 407, 408 and 701, 702, respectively)—though this could differ for other lighting applications, or could be in addition to sharp cutoff in another desired plane (see, for example, reference nos. 405, 406, FIG. 13C which indicate cutoff in a desired horizontal plane).

Figure 13B:
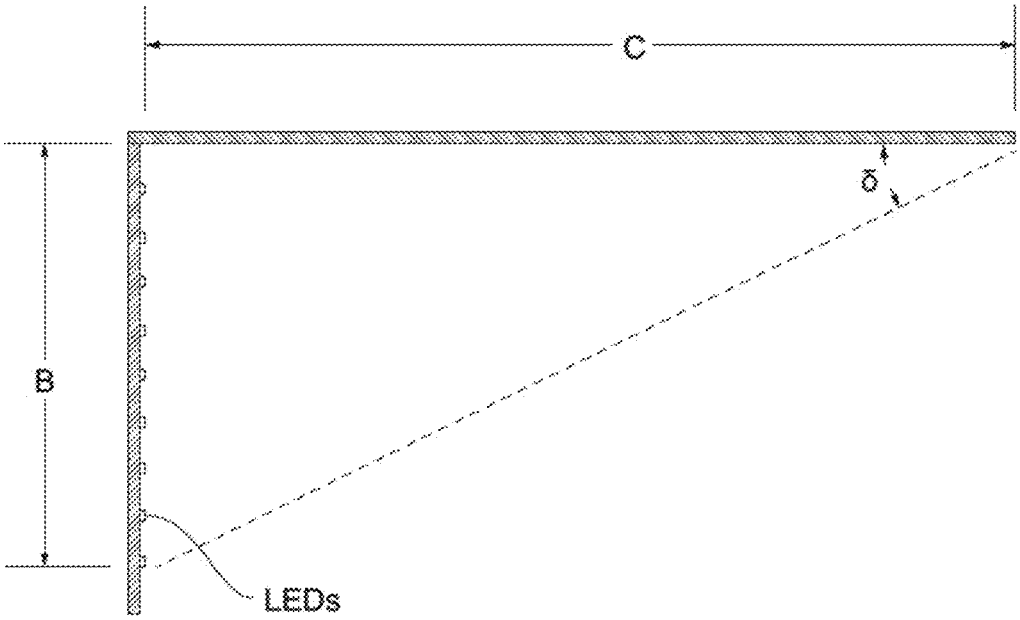

Principles of general visor operation can be understood in accordance with FIG. 13B. As can be seen from this sectioned side view of a theoretical lighting fixture, the critical angle (δ) is the angle from the bottommost light source in a column of light sources to the distalmost tip of an external visor; again, this is in the context of the vertical plane being the desired plane. According to conventional wisdom, as the height of the overall light source (B) grows, so too must the length of the visor (C) to maintain a given δ; or put another way, as lumen density increases so too must the size of the overall fixture to maintain a cutoff. This is, of course, somewhat of a simplification as most conventional lighting fixtures have LEDs recessed a good deal within a lighting fixture housing (e.g., to accommodate internal reflectors) and thus there are additional lengths and stray light to consider. Regardless, this conventional approach also applies to providing sharper cutoff insomuch that conventional wisdom suggests that to reduce cutoff (i.e., create a smaller angle over which light transitions from its maximum candela value (or photometric center) to nearly imperceptible) one can merely extend the length of visor (C) and/or tip the visor further into the composite beam produced by the LEDs. However, as has been stated, at extreme aiming angles of the visor relative the LEDs, the maximum candela shifts (which changes beam distribution and can invalidate a lighting design). Further, a visor cannot simply be extended indefinitely and without consequence; there are practical limitations in what weight/wind load can be supported on a pole or by an adjustable armature (e.g., such as that discussed in U.S. patent application Ser. No. 12/910,443 incorporated by reference herein in its entirety (now published US 2011/014592)), and long visors reaching out into a pit area or even above the plane of a track (using again the racetrack example) pose a serious safety concern.

Aspects of the present invention set forth a very compact fixture with little space between light directing devices and the emitting face of the lighting fixture (the importance of which is later discussed) and breaks the visoring into multiple parts. A first stage from a first visor portion provides beam redirection as needed by placing the maximum candela (or photometric center) at the desired location, and a second stage from a second visor portion (which is light absorbing and located some distance away from the emitting face of the lighting fixture (and may or may not be attached or structurally connected to the first visor portion depending on the embodiment)) provides beam cutoff to produce the desired beam shape. Unconventional materials on the inner surface of the first portion of the multi-part visor (later discussed) provide differential reflection to smooth out the beam and produce the desired intensity distribution.

There are a number of benefits to this approach: remotely locating a second visor portion permits one to keep the first visor portion compact (which reduces pole loading, EPA, and safety concerns), combining a light absorbing device with a reflective device permits one to provide cutoff without losing too much efficiency or shifting candela, and aiming a preliminary beam shape (i.e., after the first visor portion is added to the fixture but prior to the second visor portion being added to the fixture) ensures maximum intensity is placed where needed while being able to tailor the final beam dimensions (and without shifting maximum candela).

2. Multi-Part Optic System

As stated, the primary purpose of the multi-part optic system is to provide more or varied or otherwise tailored beam dimensions as compared to state-of-the-art LED lighting systems. The multi-part optic system generally comprises a plastic lens holder 1005B (e.g. plastic) designed to sit flush against a circuit board of LEDs 1005A in combination with a single piece secondary lens device 1005C having integrally formed secondary lenses each of which is associated with one or more LEDs; see FIGS. 26A-E. Plastic lens holder 1005B includes fill material (e.g., 20% soda lime glass) so to generally match the thermal expansion of aluminum—which, as envisioned, is the material or alloy from which the lighting fixtures of the present embodiments are formed (though this could differ)—so to better maintain general alignment with circuit board/LEDs 1005A (which are directly affixed to the lighting fixture housing) during thermal expansion and contraction. Plastic lens holder 1005B also provides form and rigidity for secondary lens 1005C which, as envisioned, is formed from silicone in a single sheet (though other options are later discussed). Silicone has comparable optical properties to conventional secondary lens material (e.g., PMMA, polycarbonate) but is operable at much higher temperatures without failure, yellowing, etc.—which is desirable for most high demand lighting applications. That being said, silicone is not a conventional material choice due to very high thermal expansion—which can cause beam distortion when the silicone heats up and bows outwardly and away from the light sources. As such, plastic lens holder 1005B also includes devices 5003 (here, plastic pegs) which extend through complementary apertures 6002 in secondary lens sheet 1005C to aid in maintaining alignment of the integrally formed lenses relative the light sources during thermal expansion and contraction.

Figure 3:
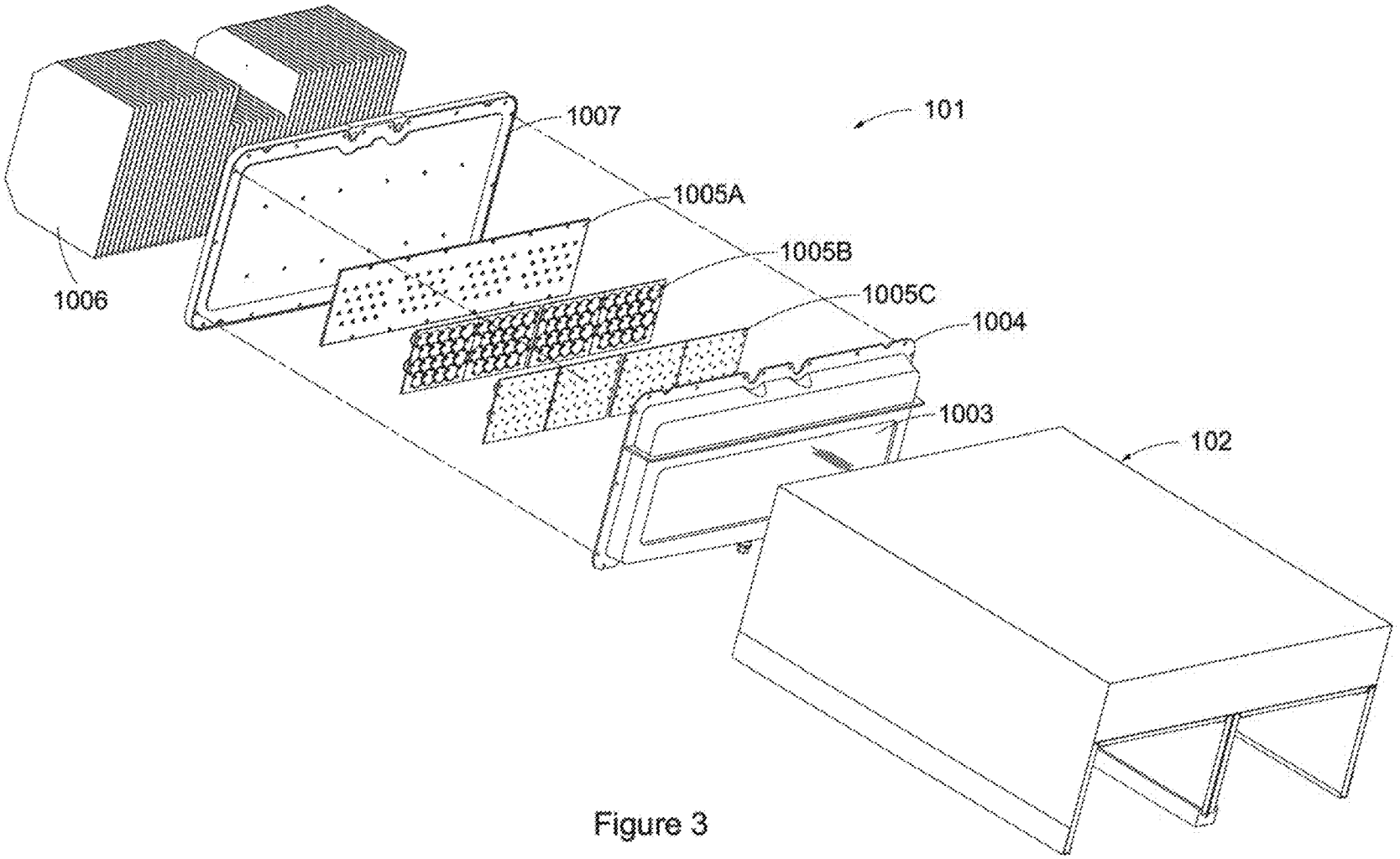
Figure 16:
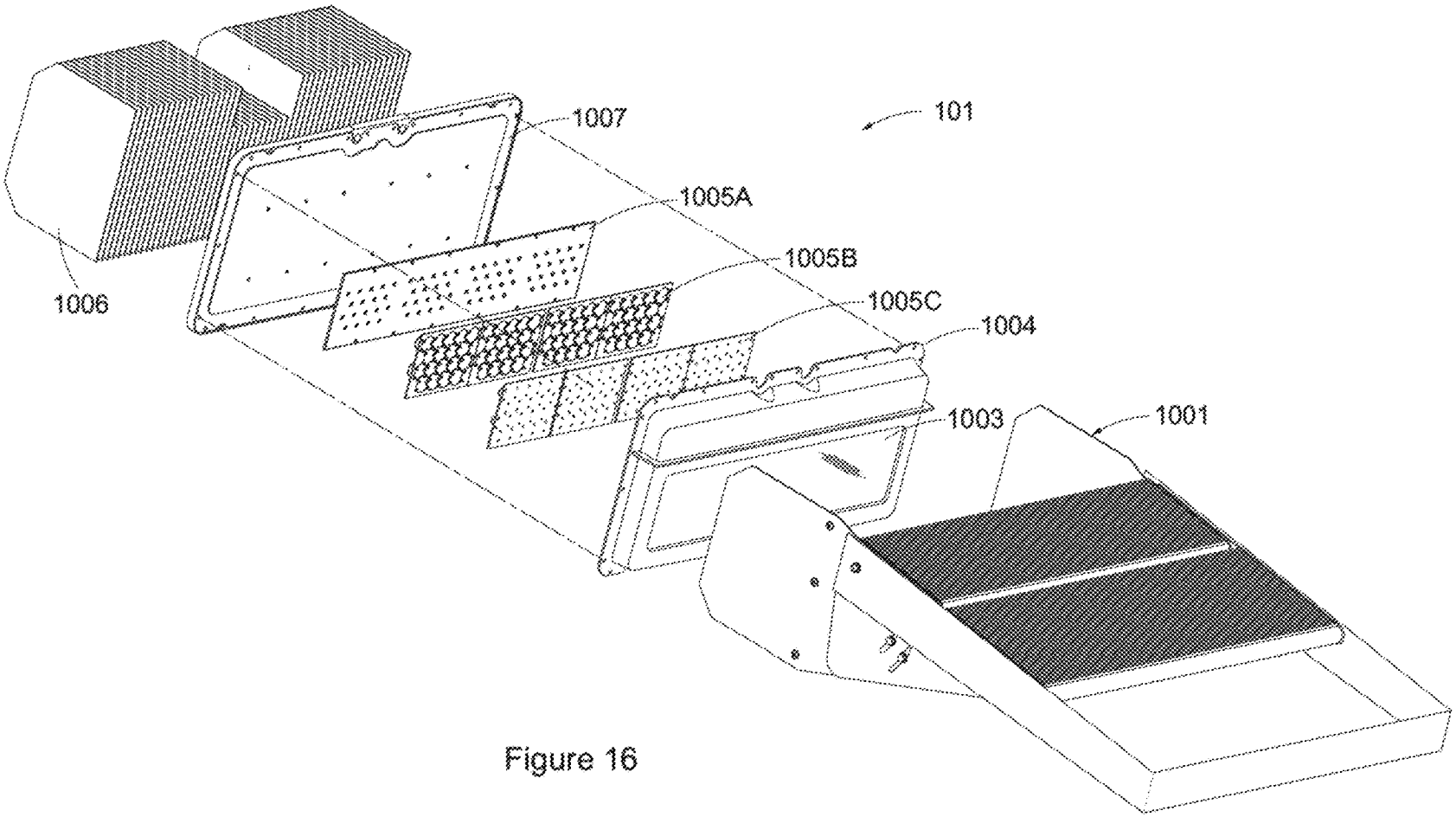
Figure 17:
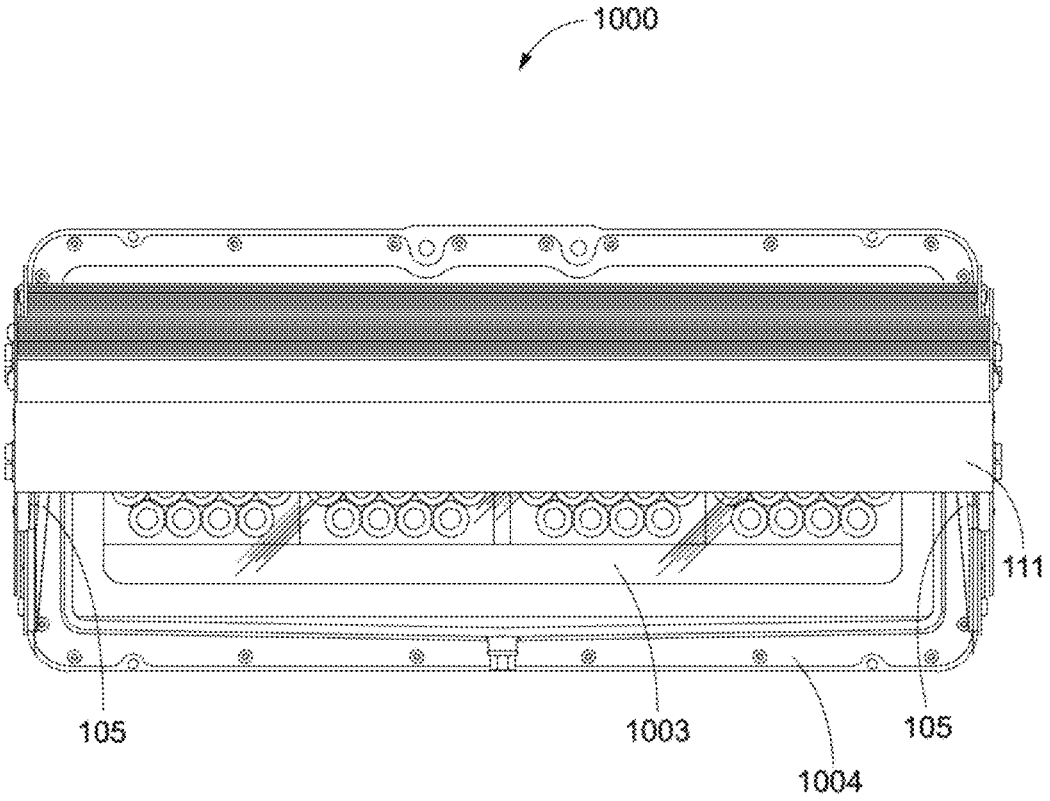
Figure 18:
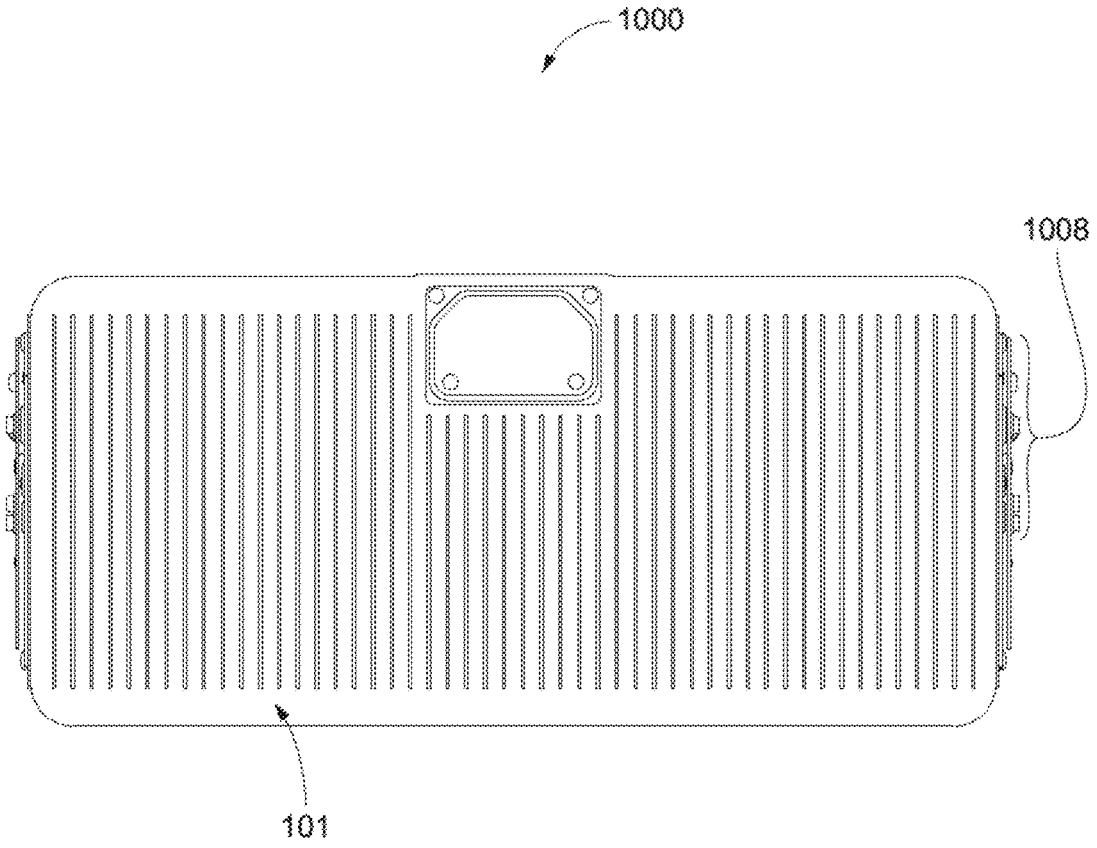
Figure 19:
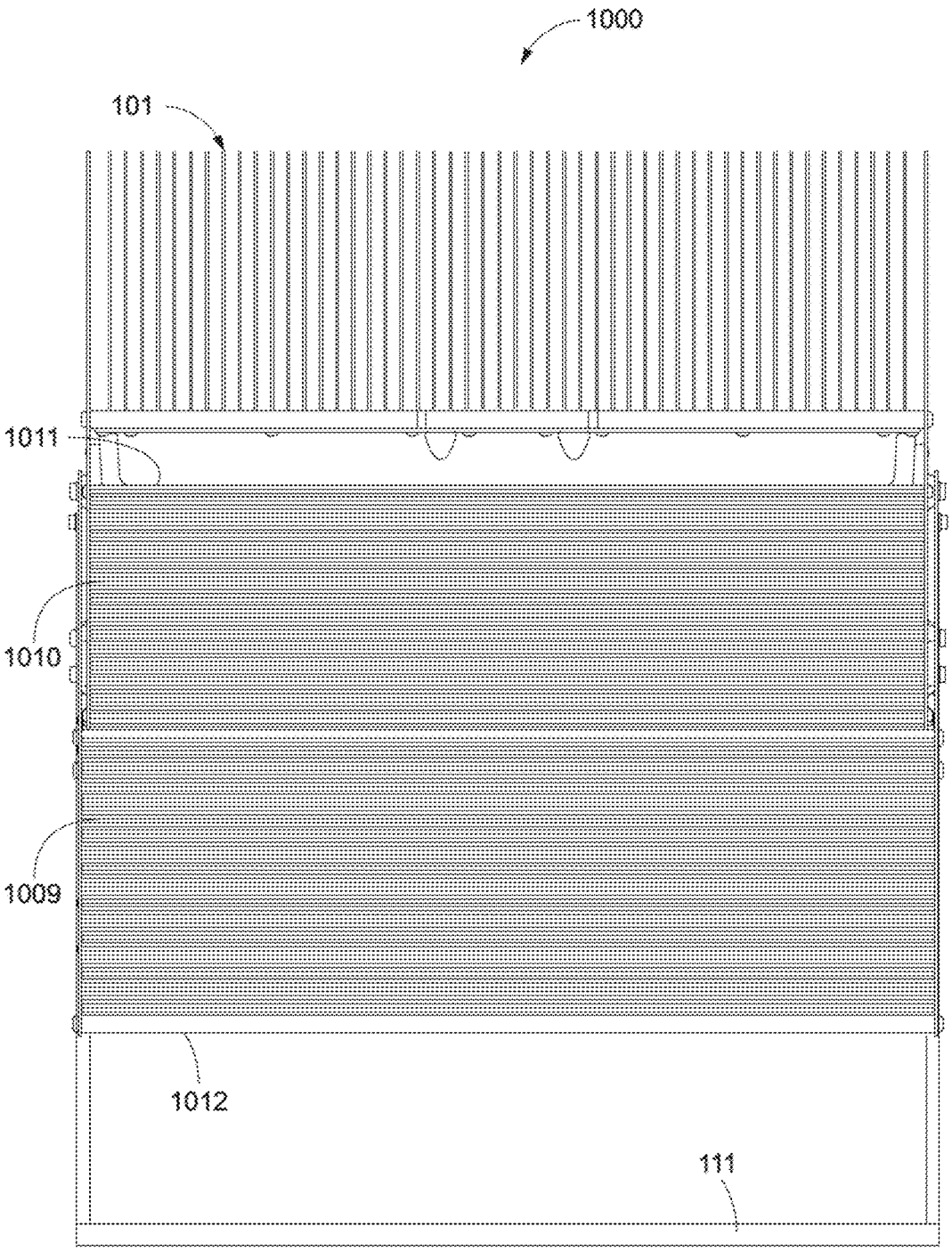
Figure 20:
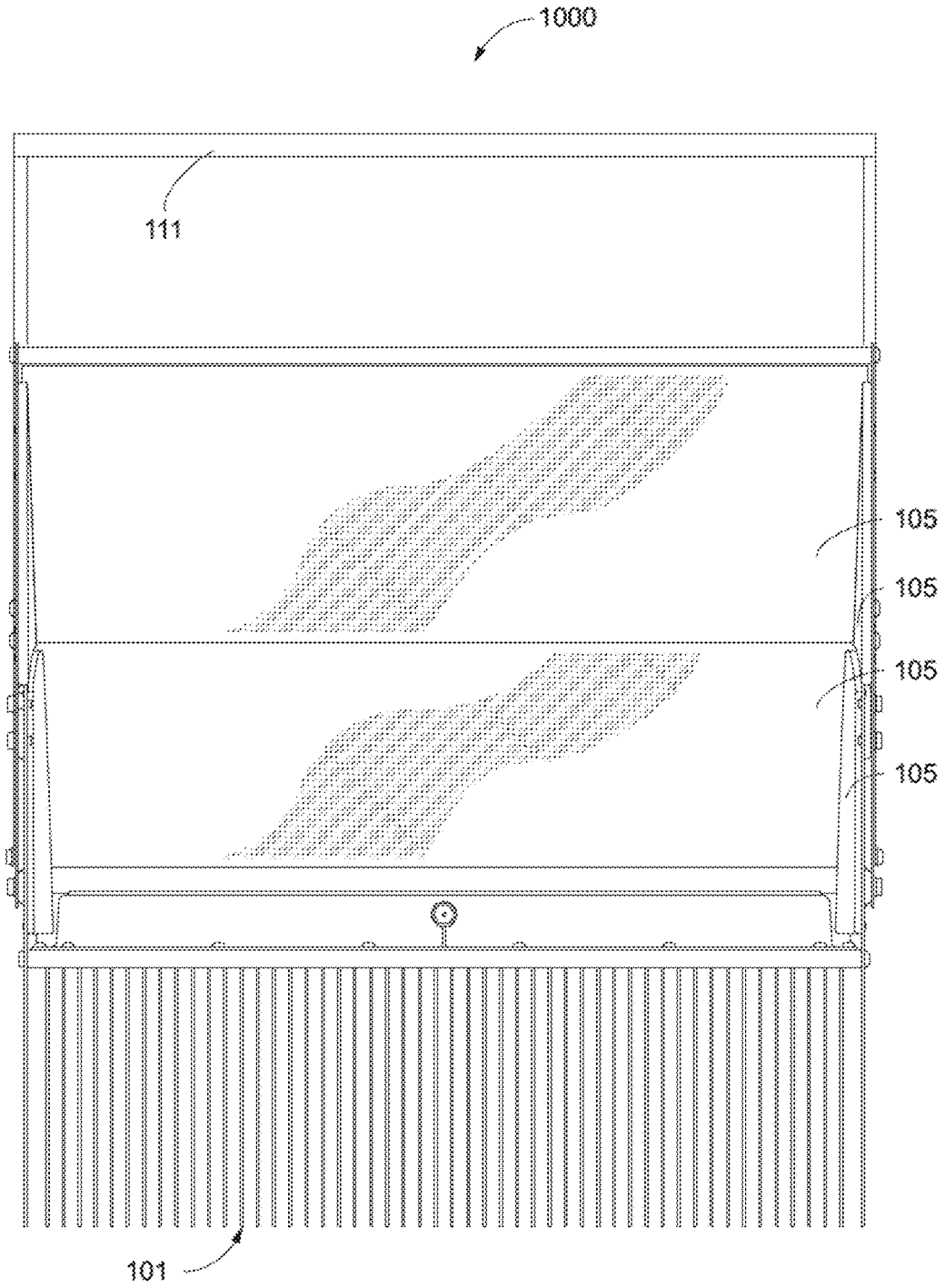
Figure 21:
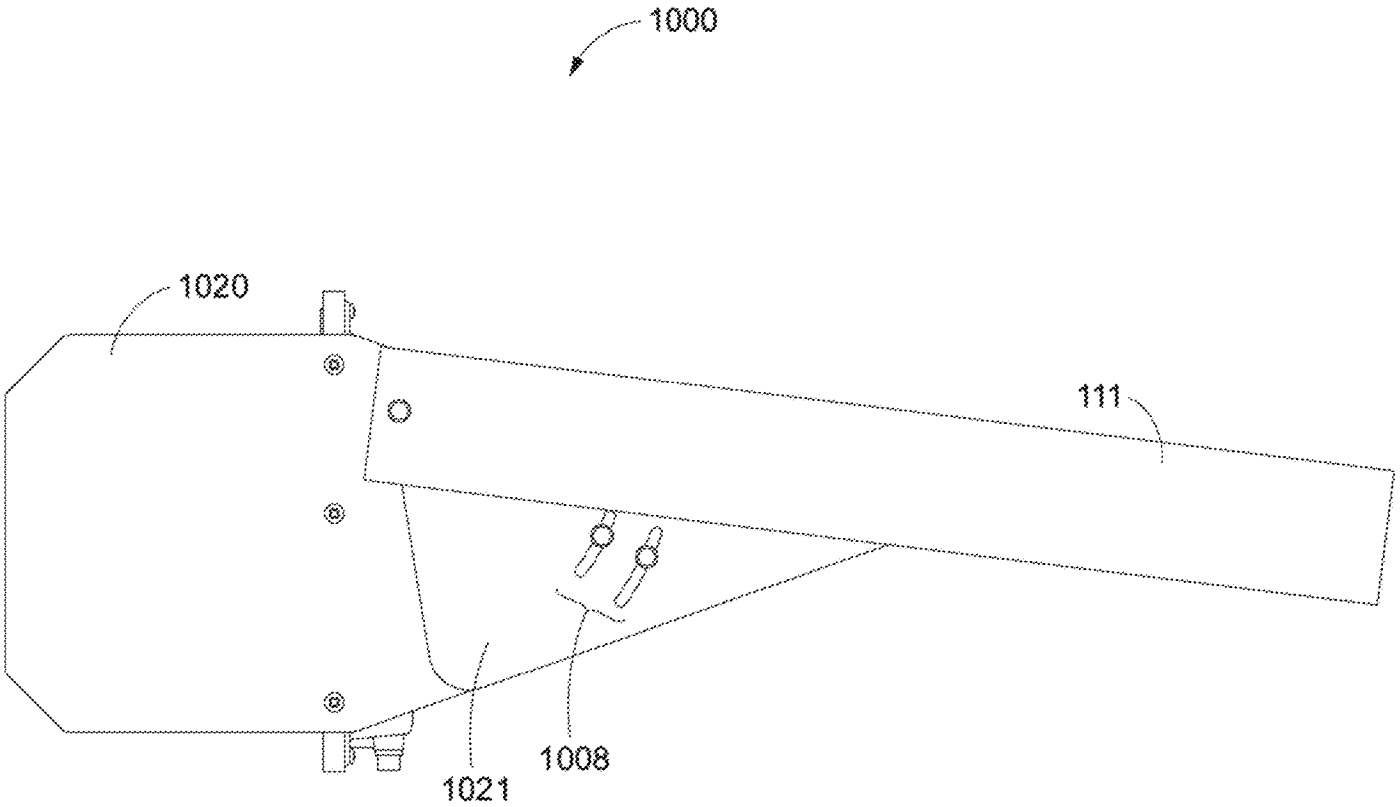
Figure 22:
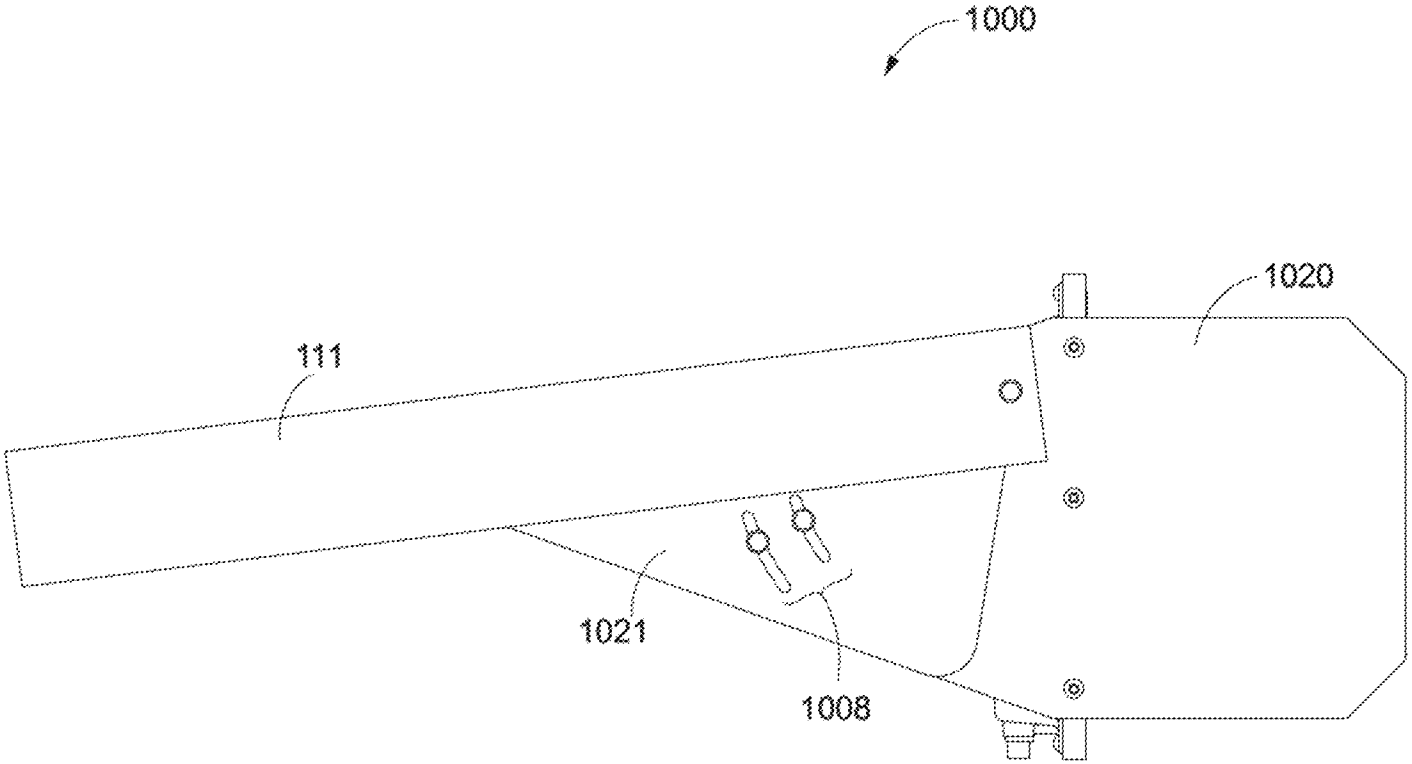
Figure 26A:
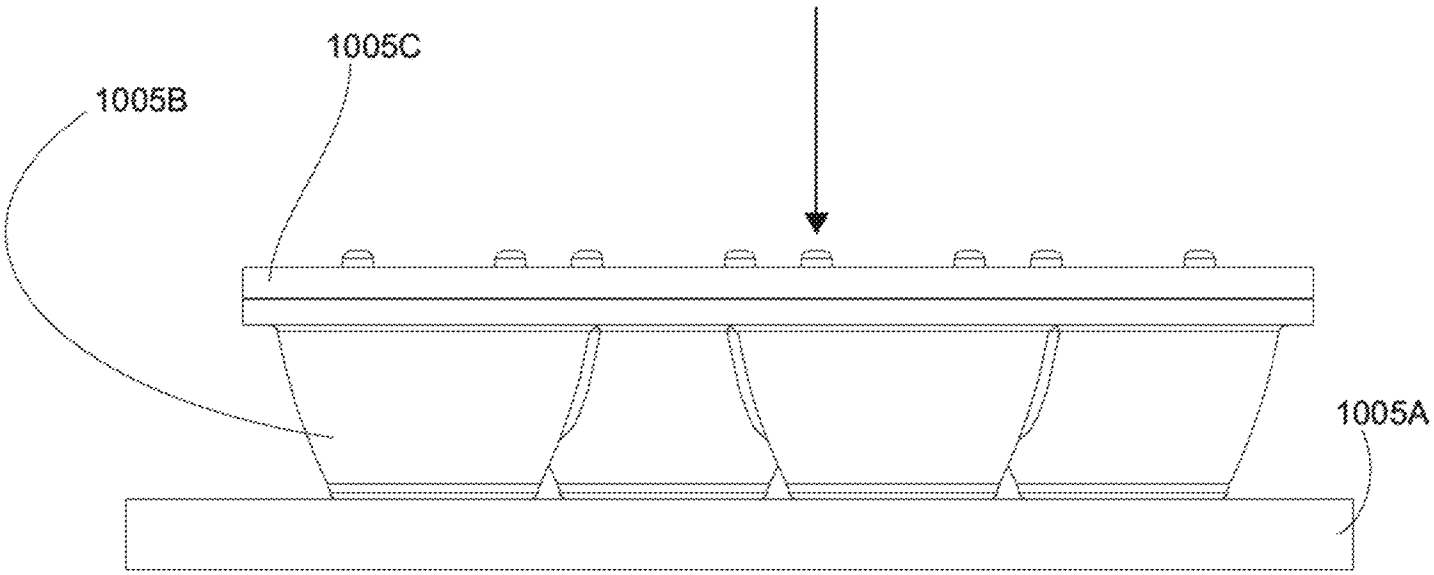
Figure 26C:
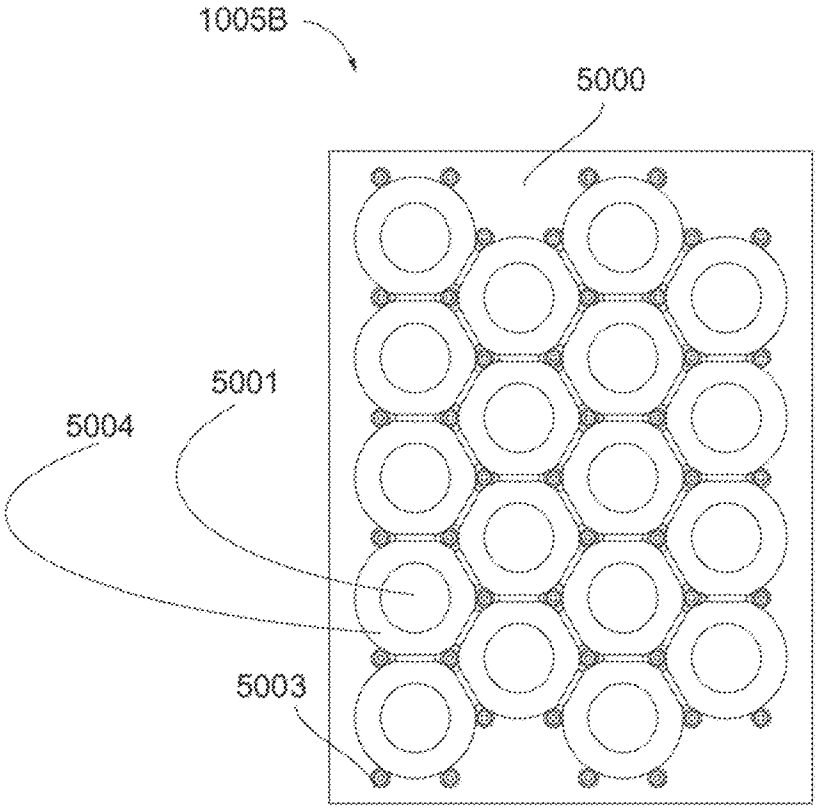
Figure 26B:
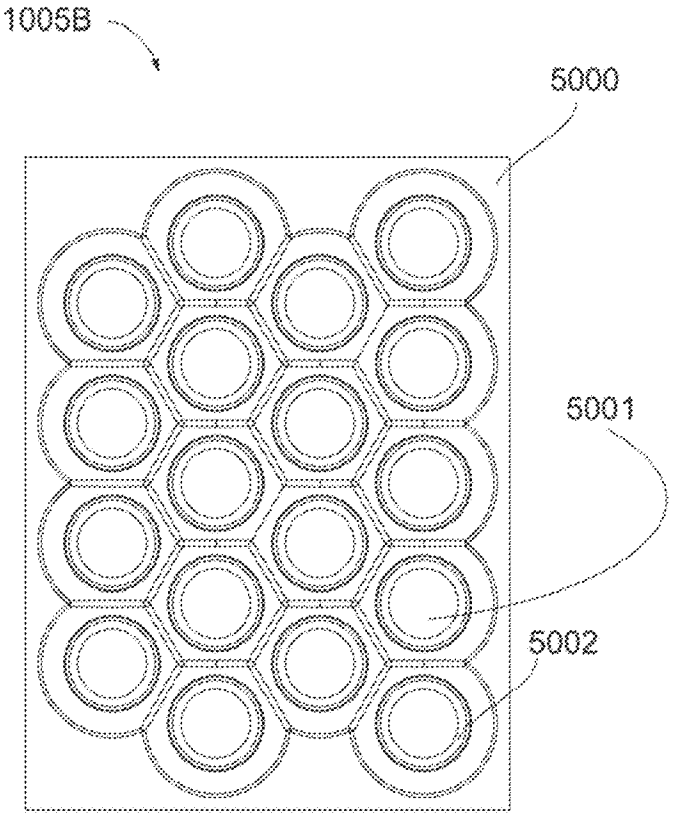
Figure 26E:
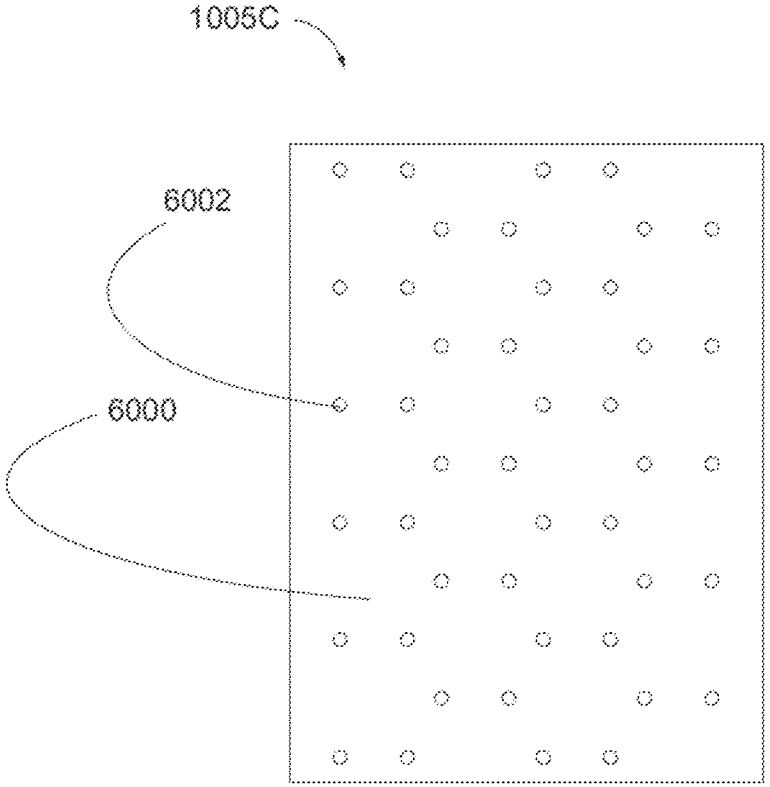
Figure 26D:
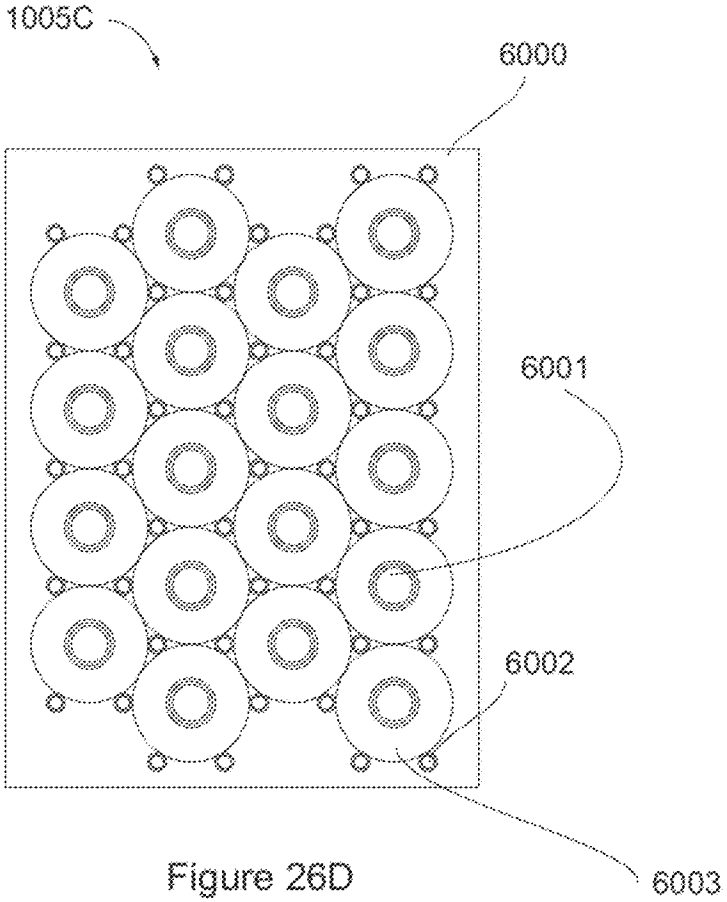

Principles of general optic system operation can be understood in accordance with aforementioned FIGS. 26A-E, as well as FIGS. 3 and 16. As can be seen from the partially exploded perspective views of FIGS. 3 and 16, boards populated with LEDs including all needed electrical connections (hereinafter collectively referred to as "LEDs" 1005A) are mounted to a thermally conductive substrate (here, mounted directly to lighting fixture housing portion 1007) so to aid in thermal transfer to preserve life of LEDs and optics alike. Whether an optic comprises a lens or a reflector or some combination thereof, optics are generally installed such that some portion (if not all) of the optic surrounds one or more LEDs so to harness and direct or redirect (as is appropriate) the light emitted from the LED. In the case of the embodiments set forth, plastic lens holder 1005B is positioned relative LEDs 1005A such that surface 5002 sits flush against the LED board and one or more LEDs are entirely contained within the boundaries of aperture 5001 in body 5000 (the thickness of which depends upon LED package size) (See FIG. 26B). The pliable integrally formed lenses of lens sheet 1005C are positioned relative plastic lens holder 1005B such that (see FIGS. 26B-E):

- pegs 5003 extend through apertures 6002 in body 6000 (the thickness of which depends upon the height of the lens)
- parabolic surfaces 6003 of the individual lenses of lens sheet 1005C sit flush against individual complementary sloped inner walls 5004 of lens holder 1005B
- light from each group of one or more LEDs surrounded by individual holders/lenses is directed through aperture 5001 into collimating surface 6001 of lens sheet 1005C The entire sandwiched assembly 1005A/B/C has a non-emitting face and an emitting face; the emitting face of the sandwiched assembly of FIG. 26A is the surface closest to the arrow. The emitting face is generally directed towards an aperture in the lighting fixture housing (here, sealed by a glass 1003, FIG. 3), the face of the lighting fixture having the aperture being defined as the emitting face of the fixture. The emitting face of the lighting fixture is generally aimed towards the target area.

As previously stated, the present invention sets forth a very compact fixture with little space between light directing devices and the emitting face of the lighting fixture—this is important for a number of reasons. Firstly, LEDs that are recessed too far in a lighting fixture housing—regardless of optic system—tend to have stray light which (i) is wasteful, and (ii) is reflected within the housing thereby creating an internal glow that causes onsite glare. Secondly, even though the two portions of the multi-part optic system are designed to work together to provide precision lighting, in the event plastic pegs 5003 fail, having glass 1003 close to secondary lens sheet 1005C aids in maintaining alignment of devices during thermal expansion of the silicone. This is a redundancy in the design as the distal tip of each peg 5003 (approximately 0.040" of material projecting above the emitting face of secondary lens sheet 1005C) is heat staked, but a beneficial redundancy. Heat staking generally comprises flattening the distal tip of pegs 5003 in the general direction of the arrow in FIG. 26A such that the diameter of the flattened pegs 5003 exceed the diameter of apertures 6002 so to resiliently hold and prevent secondary lens 1005C from flexing to the point that the beam would be impacted. Heat staking is not a new process, though it is not conventionally used with silicone materials. Lastly, a very compact fixture (e.g., with no internal visors) permits a more dense packing of LEDs which, ultimately, allows one to drive the LEDs at a lower current to achieve a desired luminous output (thereby extending LED life and reducing energy costs), or allows one to extract more lumens from a lighting fixture for a given high demand lighting application.

3. Multi-Part Differential Reflection System

As stated, the primary purpose of the multi-part differential reflection system is to provide improved intensity distribution at or near beam pattern edges and/or across beam patterns as compared to state-of-the-art LED lighting systems. In some high demand lighting applications fixture setback is variable and spacing between fixtures is variable such that there are dark spots between fixtures (even if overall uniformity requirements are being met); without some form of light redirecting device to smooth out and overlap beams between fixtures, a driver on a racetrack at high speeds, for example, may perceive a "strobe" effect (i.e., where the driver perceives a rapid bright-dark-bright-dark effect at his/her periphery) which can be particularly debilitating. Conventional wisdom—see aforementioned U.S. Pat. No. 5,887,969—relies upon flexible reflective strips which can be bent and flexed to redirect the light of a large, elongated light source towards the racetrack in a manner that both allows for beam blending and prevents a driver from directly viewing the source (which can cause onsite glare). However, this approach is inadequate to address LED lighting fixtures because the approach cannot manage the multiple focal points and different cutoff points of LEDs in an array; namely, striations appear at the beam edges when using this conventional method with LEDs (which can also produce a strobe effect). Conventional LED reflectors such as metalized plastic reflectors or coated ceramic reflectors melt at typical operating conditions or are too costly to coat to the needed degree of precision for high demand lighting applications, respectively, and so are not a suitable replacement. The multi-part differential reflection system of the present invention departs from conventional wisdom entirely and comprises a plurality of devices stacked to provide both structural rigidity and varying degrees of transmittance in a desired plane. As previously stated, the multi-part differential reflection system can also be combined with the multi-part visoring system not to improve intensity distribution near beam edges per se (as edges are sharply cut off due to the visoring), but to aid in smoothing out the overall beam (i.e., spreading out candela within a beam pattern without changing the size and shape of the beam pattern) and reducing onsite and/or offsite glare.

Figure 13C:
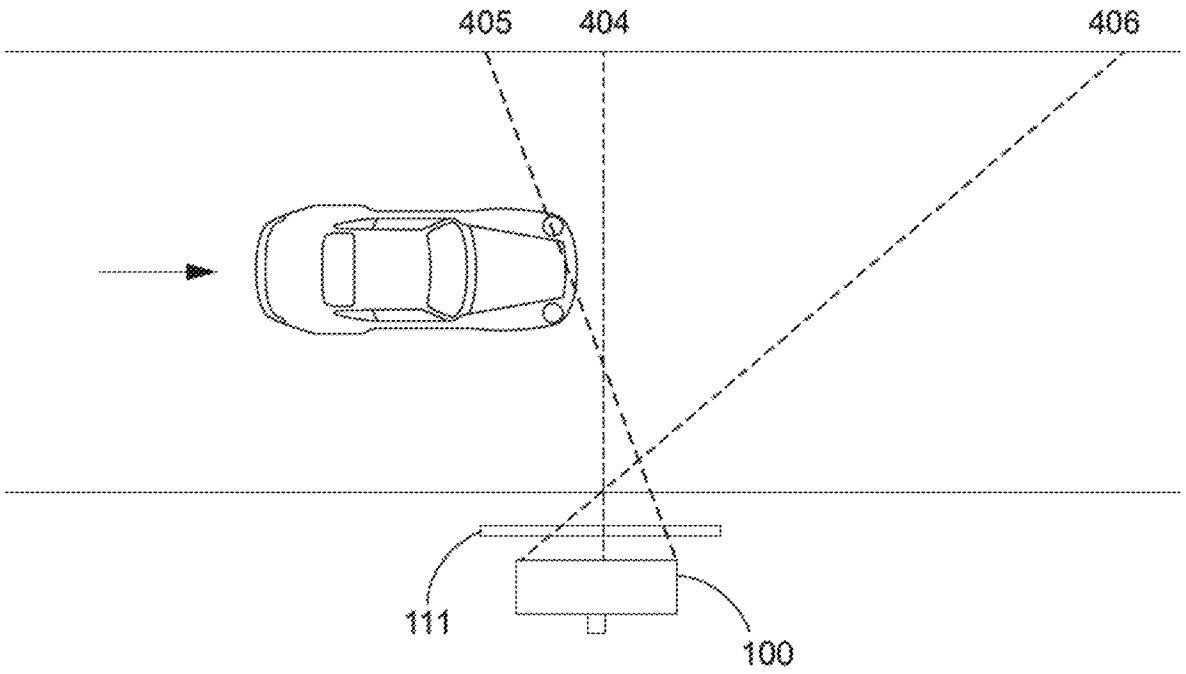
Figure 14:
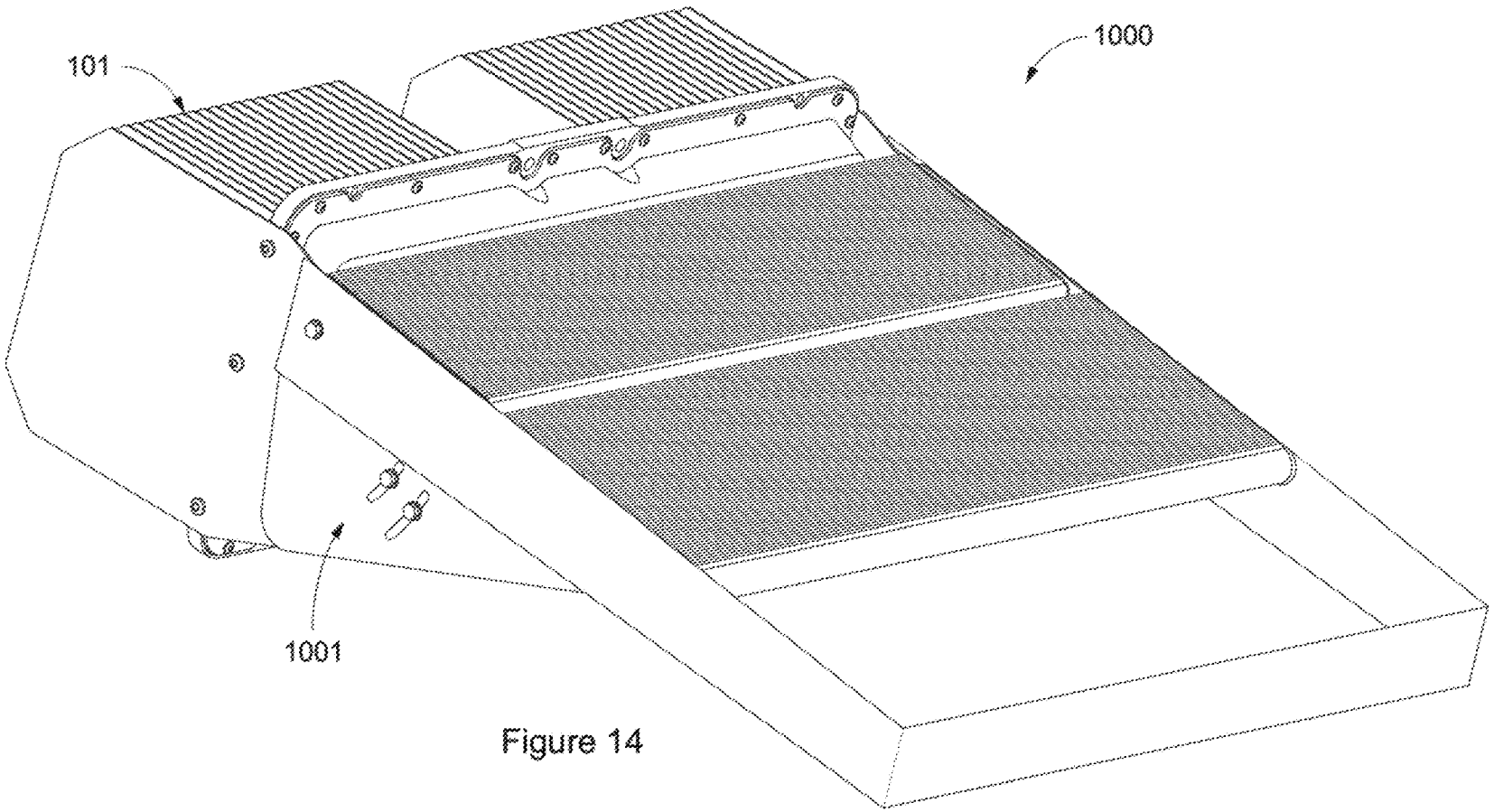
Figure 15:
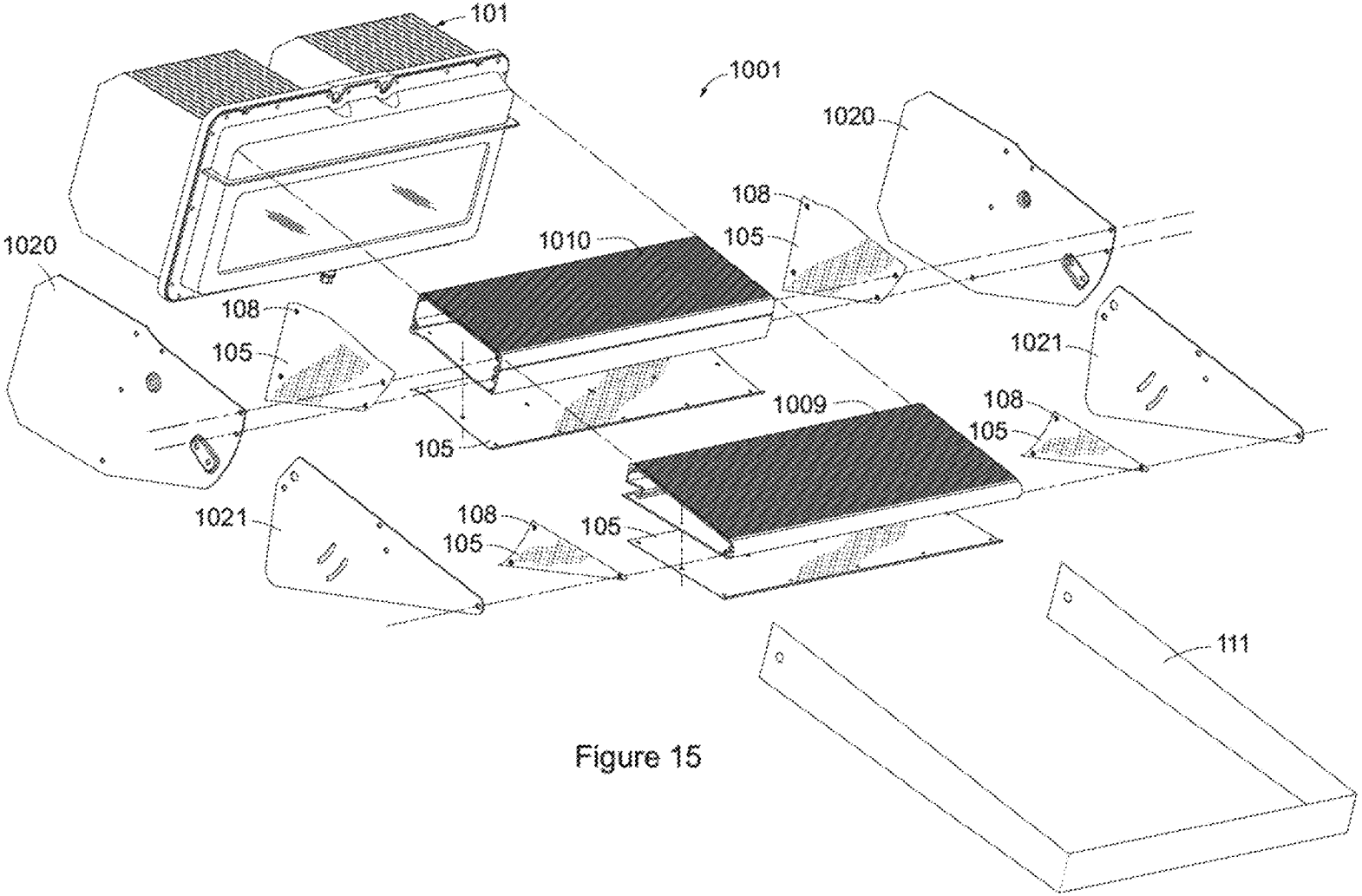

Principles of differential reflection can generally be understood in accordance with FIGS. 2 and 15, as well as FIG. 13C and Table 1 below. As can be seen from the partially exploded perspective views of FIGS. 2 and 15, one or more devices are layered on the inner surfaces (sides and top) of the multi-part visoring system so to provide varying degrees of transmittance/reflection in the horizontal and vertical planes. That being said, because the second visor portion of the multi-part visoring system only extends in the vertical plane, sharper cutoff is provided in the vertical plane (see again FIGS. 13A and 25) whereas a softer cutoff (sometimes referred to as a "feathering" of light) is provided in the horizontal plane—which is beneficial in blending light from fixtures to avoid strobe effect, overlapping beams to produce a composite beam of desired shape and/or intensity, and tailoring horizontal beam control so to provide light where needed (see reference nos. 404-406, FIG. 13C). Differential reflection operates on the principle of second surface mirrors; namely, coating the back surface (instead of the front/first surface) of a mirror or other material so that the angle of reflection is slightly different than the angle of incidence (which may or may not come at a slight cost to reflectance). This is a departure not only from conventional wisdom in lighting design but from that in the art of designing second surface mirrors insomuch that second surface mirrors often have a "ghost image" or "ghosting effect" which is a faint secondary reflection and is generally to be avoided (e.g., by additional processing), but in the present invention it can actually be a boon—because it is reflected at a different angle than the rest of the reflection it aids in smoothing out the beam distribution.

The present invention sets forth the use of unconventional materials to provide differential reflection, of a thickness so to be rigid (e.g. on the order of 0.020"), thereby adding structure and rigidity to the visoring system and aiding in easy insertion/removal to facilitate tailored beam properties. While any material capable of being painted, coated, processed, etc. to operate as a second surface mirror could be used, some materials tested better than others for purposes of the present invention. In terms of finish or reflection, materials that were processed to produce diffuse reflection were first evaluated for the multi-part differential reflection system as diffusers are common in the lighting industry for purposes of smoothing out a beam pattern. However, it was found diffuse surfaces resulted in a complete lack of beam control, a distracting glow at the fixture, and a large loss in transmission efficiency when used to provide differential reflection. As such, a number of materials which produce specular reflection were tested: typical low iron soda lime glass, said glass coated on one side with anti-reflective coating (e.g., Guardian Anti-Reflective Glass for Lighting available from Guardian Industries, Carleton, Mich., USA), said glass coated on both sides with said anti-reflective coating, said glass coated on one or both sides with black paint, and glass that was commercially tinted (e.g., Guardian PrivaGuard available from aforementioned Guardian Industries). It was originally thought the smoothness of the material surface would greatly impact the ability to provide said improved intensity distribution at or near beam pattern edges and/or across a beam pattern and that the surfaces which were painted would perform more poorly in this respect; this too proved not to be the case, as all blackened surfaces tested performed comparably at the beam edge.

Test results are shown in Table 1.

TABLE 1

| Test Condition (single side visor) | Maximum Cd (Cd) | Total lumens (lm) | ½% Max Cd (Cd) | Horz Angle at ½% Max Cd (degrees) |
|---|---|---|---|---|
| No visor | 330758 | 21434 | 1654 | 28 |
| mirror | 459327 | 20224 | 2297 | 28.5 |
| A/R (both sides) | 458112 | 18630 | 2291 | 22 |
| Glass with black backing | 458602 | 18483 | 2293 | 22 |
| Specular black painted aluminum | 457563 | 18673 | 2288 | 22 |
| Flat black painted aluminum | 458851 | 18226 | 2294 | 22 |
| Highly specular black painted aluminum | 460578 | 18613 | 2303 | 22 |
| Miro ® 4* aluminum | 461595 | 20311 | 2308 | 29 |
| Glass with black backing, coated upper visor | 402386 | 15467 | 2012 | 21.5 |

*available from Alanod GmbH & Co. KG, Ennepetal, Germany

All of the specular reflection materials tested in Table 1 avoided shifting the maximum candela in the desired plane, and so were then evaluated in terms of overall beam spread in the desired plane (here, the horizontal plane) and perceived glare (here, ½% of the maximum measured candela). As was expected, the control condition without side visors had the lowest measured glare but the highest beam spread; this makes sense because there are no surfaces available to provide horizontal beam containment. In terms of glare, it is important to note that "glare" can be defined a number of ways with a number of thresholds. 500 candela is a rule of thumb threshold for perceived glare—but that is only under conditions with a single light source and a dark background (e.g., an offsite condition). Drivers, athletes, and spectators alike have their field of view populated with light sources (e.g., an onsite condition), and the ambient light level is much higher (i.e., they have a higher adaptation level), and so it has been found that candela values upwards of 3000 still do not cause glare under most circumstances. In fact, throughout testing it was found that the only time glare was perceived was when the LEDs themselves were directly visible; reflections of the LEDs produced via differential reflection and general light at the edges of the fixture did not cause perceived glare in the subjects tested. Of course, this conclusion may not extend to first surface mirrors—the results herein should only be taken with respect to second surface mirrors used to produce differential reflection.

With further regards to Table 1, there were some surprising results; specifically, that many of the materials tested had comparable beam spread and comparable perceived glare. As such, many of the materials could be interchangeable. Coated aluminum may prove to be the cheapest option, but glass is more rigid and perhaps better in high wind load situations. Materials with fill or otherwise coated or imbued with transmission altering properties are not prone to chipping or UV damage like painted surfaces, or prone to corrosion like silver mirrors, though the A/R coating in particular changed perceived color of the beam (which may be undesirable for televised events that require excellent color rendering). Ultimately, any number of or type of these unconventional devices may be layered to provide a combination of desired beam spread, beam intensity distribution, perceived glare, transmission efficiency, and rigidity; they could even be combined with conventional devices (e.g., black glass layered on the aluminum sheet which forms the visor).

4. Lighting High Demand and/or Difficult-to-Light Applications

Figure 27A:
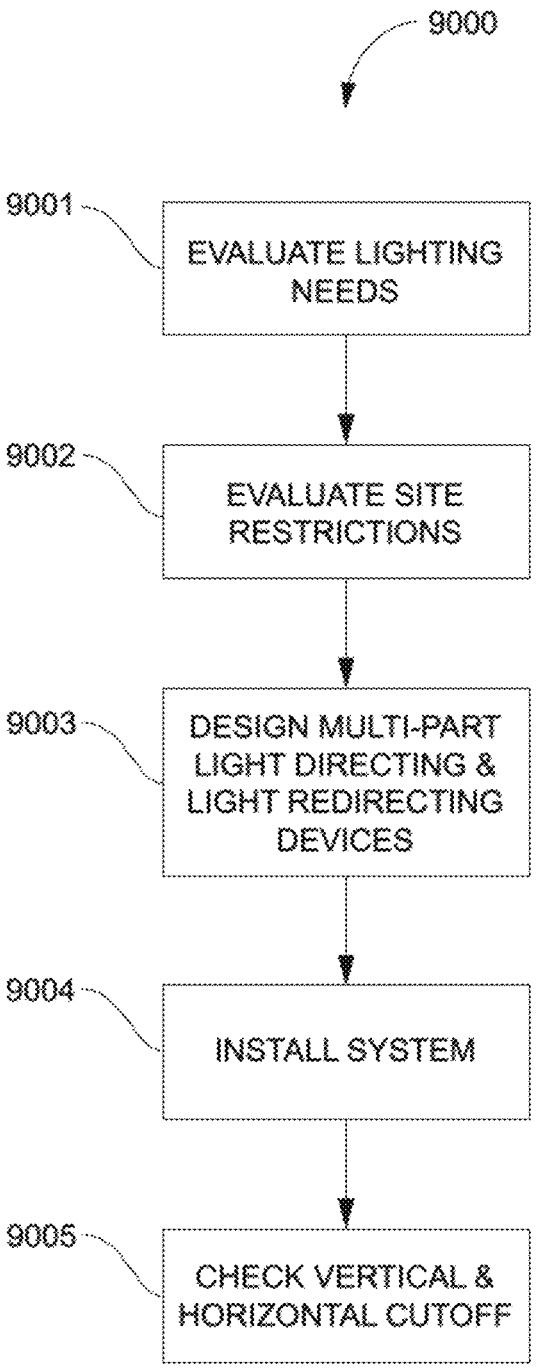

FIGS. 27A and B illustrate one possible method of lighting a high demand lighting application and/or difficult-to-light lighting application using one or more of the multi-part visoring, multi-part optic, and multi-part differential reflection systems just described. Using again the examples of an irregular racetrack and a five-pole baseball layout, method 9000 flows thusly.

According to a first step 9001, the lighting needs of the application are evaluated. This is an important step because it will determine whether the target area is primarily 2D (e.g., a ground sport) or 3D (e.g., an aerial sport which may require uplight—later discussed), which planes need sharp beam cutoff, which planes need light blended or feathered, what overall intensity and distribution is needed (e.g., for a specific level of play), and the like. At the completion of step 9001 it will likely be known which style of visoring system will be used; namely, the boxier style (Embodiments 1 and 2, see infra) which provides greater flexibility in the horizontal plane but requires lower mounting heights (e.g., under a dozen feet) and/or smaller aiming angles (e.g., a few degrees at the adjustable armature), or the wedge style (Embodiments 3 and 4, see infra) which provides less flexibility in the horizontal plane but can accommodate much higher mounting heights (e.g., dozens of feet) and/or aiming angles (e.g., around 30 degrees at the adjustable armature).

According to step 9002 site restrictions are evaluated. Knowing which style of multi-part visoring system will be used according to step 9001 better enables a lighting designer to determine which configuration of multi-part visoring system (i.e., attached or remote) is best suited to the site. For example, consider an irregular racetrack (FIG. 13A); here, a turn with an unusually long setback Z (on the order of 300 feet) and an unusually sharp cutoff between the top of a wall P and the beginning of stands L (on the order of 3 feet). Site restrictions dictate a single row of LEDs to obtain the sharpest possible cutoff; upper beam cutoff 407 must illuminate the track wall (e.g., for advertisement purposes) at a height P of 4 feet but be cut off prior to stands 120 at a height L of 7 feet (e.g., to prevent causing onsite glare). The large swath of road, however, must also be lit by said single row of LEDs—which means a large beam spread (i.e., a large angle from upper beam 407 to lower beam 408). Also, the fixture must be mounted above the average eye height of a driver to avoid perceived glare and strobe effect—which means height X must be around 8 feet (depending on the type of track and car (determined in step 9001)). Finally, because stands 120 extend a height Q of 30 or more feet, a remotely located second visor portion is most appropriate given the site restrictions so that any stray light (see stray light beam 409) is also cut off; this is an unusual circumstance insomuch that it is unusual to have to be concerned with light 30 feet above the target area in a ground sport application. By locating second visor portion 111 remotely from the rest of fixture 100 a distance Y of 15 feet, second visor portion 111 can be designed to span a specific distance R (here, 26 inches) at a mounting height H (here, 8.5 feet) so to collectively (i) cut light off so no spectator can directly view the light sources, (ii) keep light sources mounted above the average eye height of a driver to avoid perceived glare and strobe effect, and (iii) illuminate a large swath of road and wall and car under visor portion 111 and between posts 203—this is all considered in accordance with step 9002. However, this is only part of step 9002—site restrictions in other planes must be considered as well. In the horizontal plane a driver would prefer light be projected forward of the vehicle (see forward beam cutoff 406 of FIG. 13C), but broadcasting needs typically necessitate a forward beam cutoff right at the tip of the vehicle (forward beam cutoff 404), or in some extreme cases, actually upstream of the driver (forward beam cutoff 405). These needs and restrictions should be considered in accordance with step 9002 for each lighting fixture and mounting location as it can be seen that reflecting light in a horizontal plane at, for example, 5 degrees (for a total horizontal beam spread of 10 degrees), may suit one situation particularly well, but at a different point on the same target area (e.g., at a different point on a racetrack), that same 5 degrees (10 degree horizontal spread) may be insufficient (e.g., may make the sources directly viewable, may not be a large enough spread to fully light the track).

Figure 25:
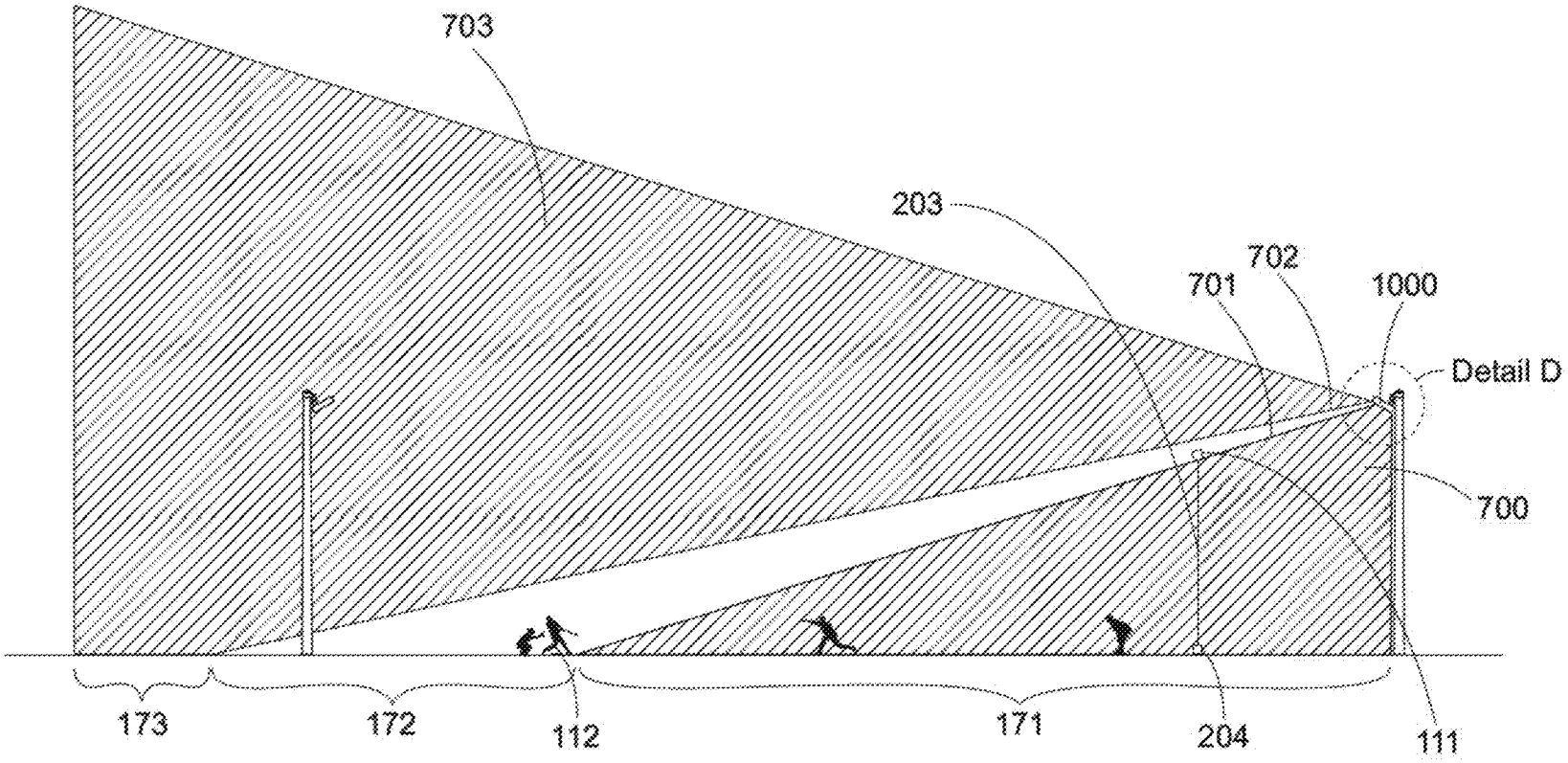

Of course, step 9002 may require multiple determinations/considerations in a single plane rather than a single determination in multiple planes; this is illustrated in FIG. 25 for a five-pole baseball layout. Here a new design of pole layout currently being adopted in the industry requires a single pole behind center plate rather than the more typical and costly staggered eight-pole layout. A five-pole layout requires precision lighting so to place light where it is needed but sharply cut it off before it hits the eyes of a batter 112, only to resume again behind the batter (e.g., to backfill area 173/703 to ensure adequate intensity, uniformity, and modeling of a ball in flight). As can be seen in FIG. 25, both playing field 171 and aerial space above 700 needs to be illuminated by fixture 1000, but light must be cut off (see reference no. 701) so not to illuminate area 172 nor cause glare for a batter 112. Light behind batter 112 at playing field area 173 (see reference no. 702) and the aerial space above 703 may be provided from another fixture (not illustrated) in the array at the same pole location, or from the same fixture with a split beam. FIG. 25 illustrates one situation where step 9002 includes detailed evaluation of site restrictions in a single plane (here, the vertical plane), but less in another plane (e.g., horizontal plane)—which, again, can differ for each lighting fixture and mounting location.

According to a third step 9003 the multi-part visoring, multi-part optic, and multi-part differential reflection systems are designed to suit the lighting needs of step 9001 given the site restrictions of step 9002. With respect to the multi-part optic system, silicone itself has excellent flow properties and so secondary lens sheet 1005C could be formed to create integrally formed narrow beam lenses, wide beam lenses, a combination of the two types of lenses, or other beam types within a single sheet. Secondary lens 1005C (FIG. 26A) could even be created in strips so that a single lighting fixture could contain multiple rows of precisely controlled light, each with its own beam size/shape. This could be useful in producing composite beams of a custom shape (e.g., for curves in racetracks) which might be further modified (e.g., to sharpen cutoff, reduce glare) by the multi-part visoring system and/or multi-part differential reflection system.

Figure 4:
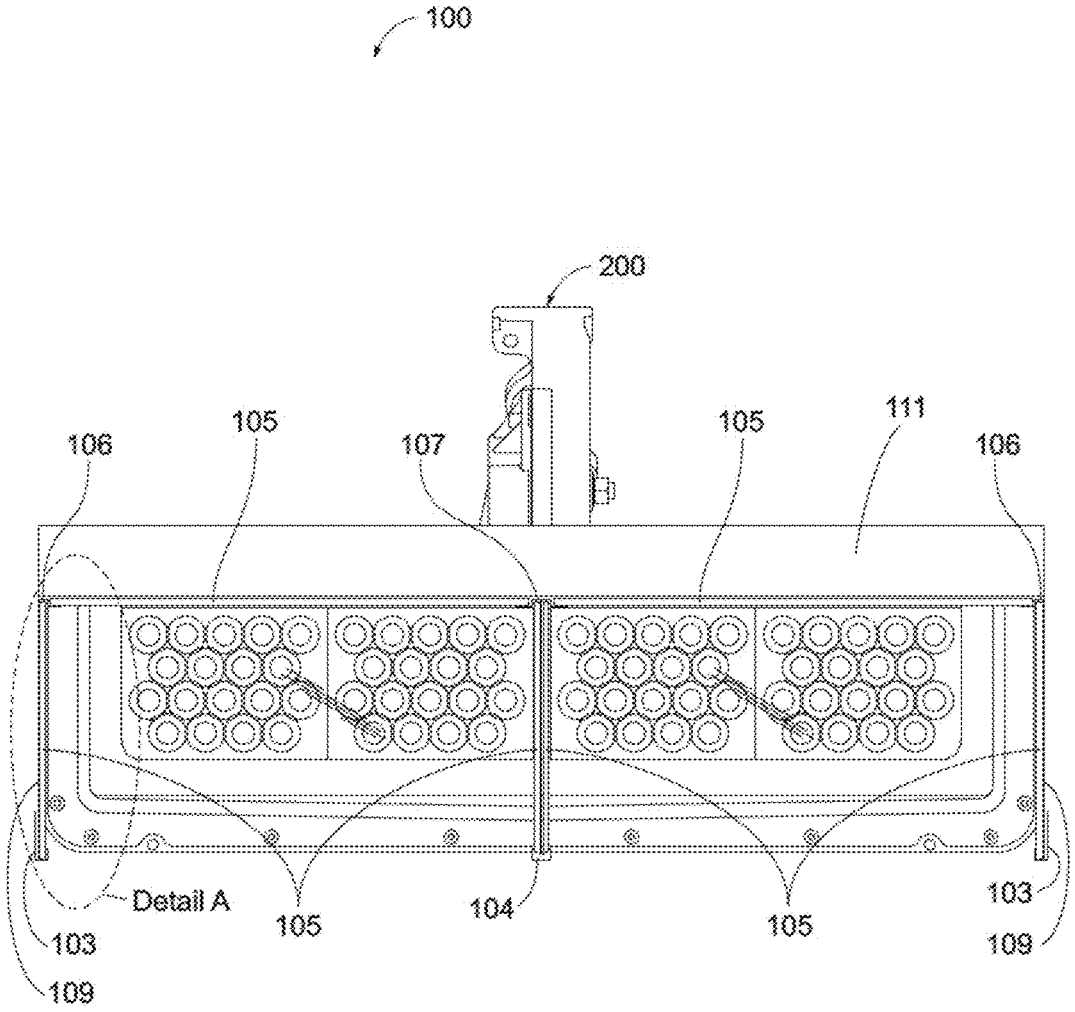
Figure 5:
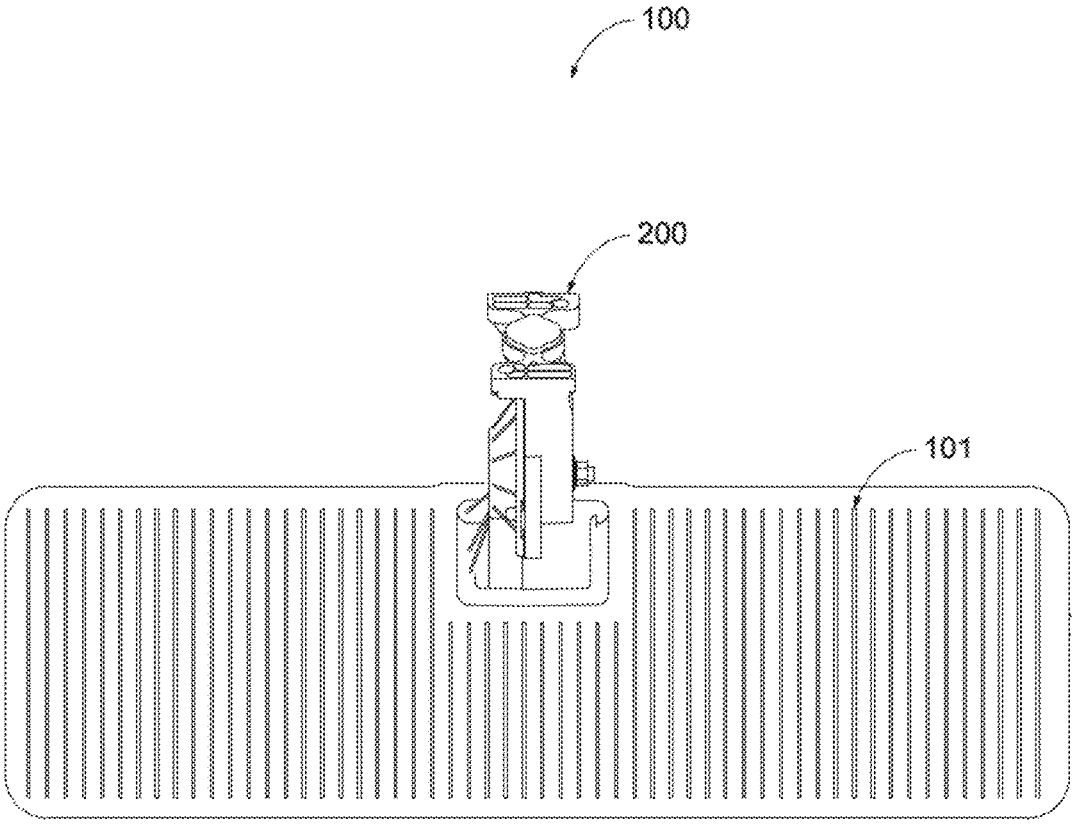
Figure 6:
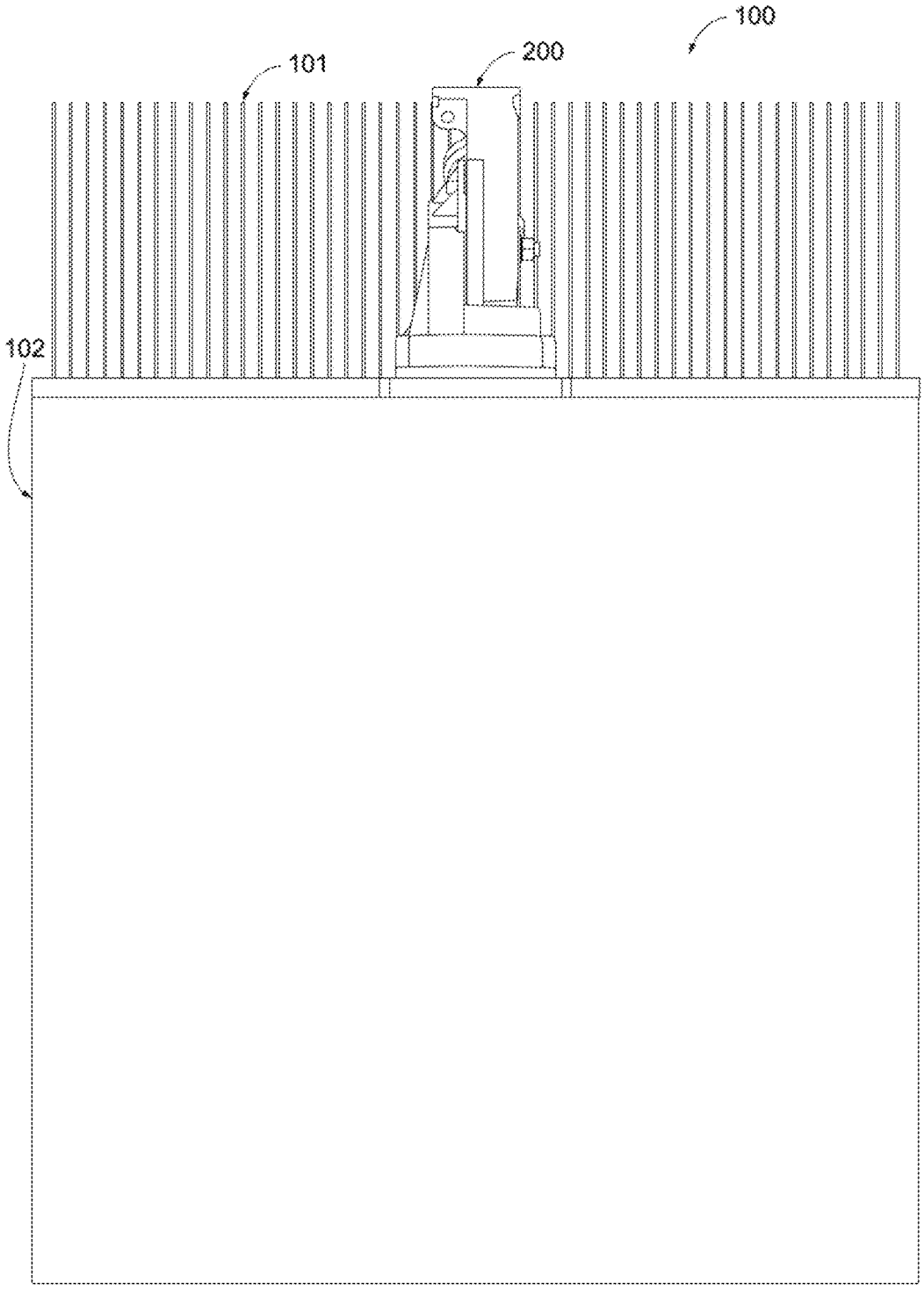
Figure 7:
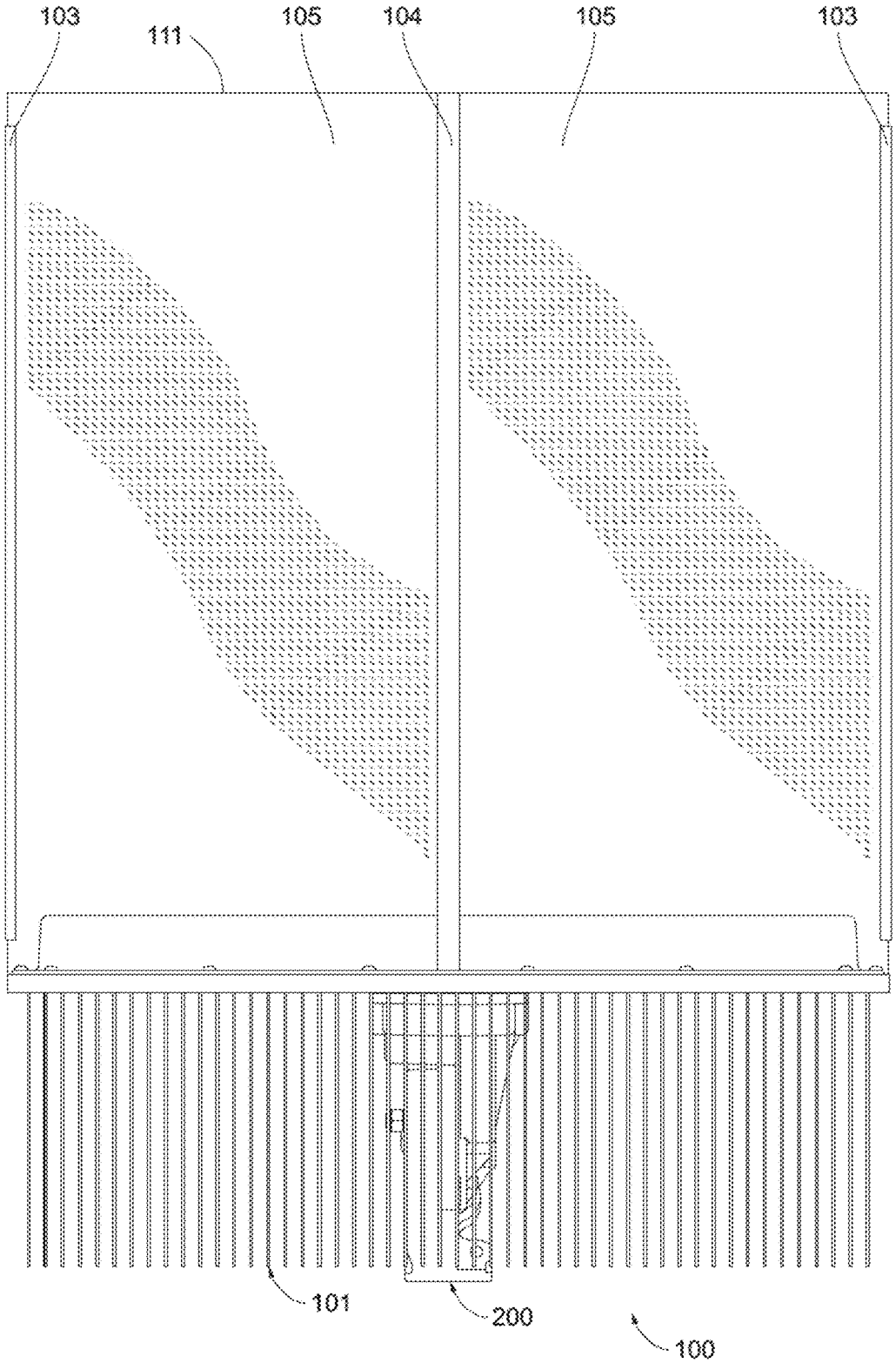
Figure 8:
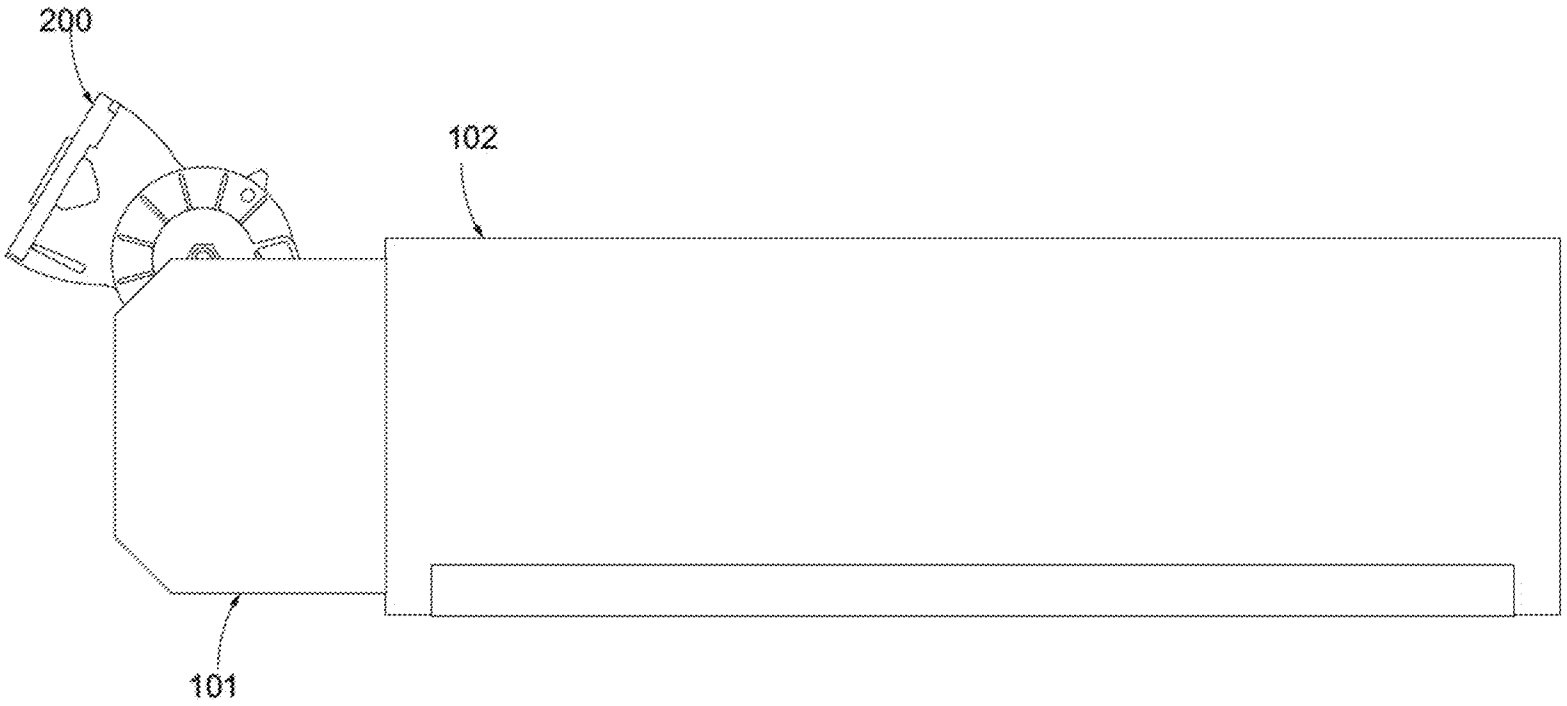
Figure 9:
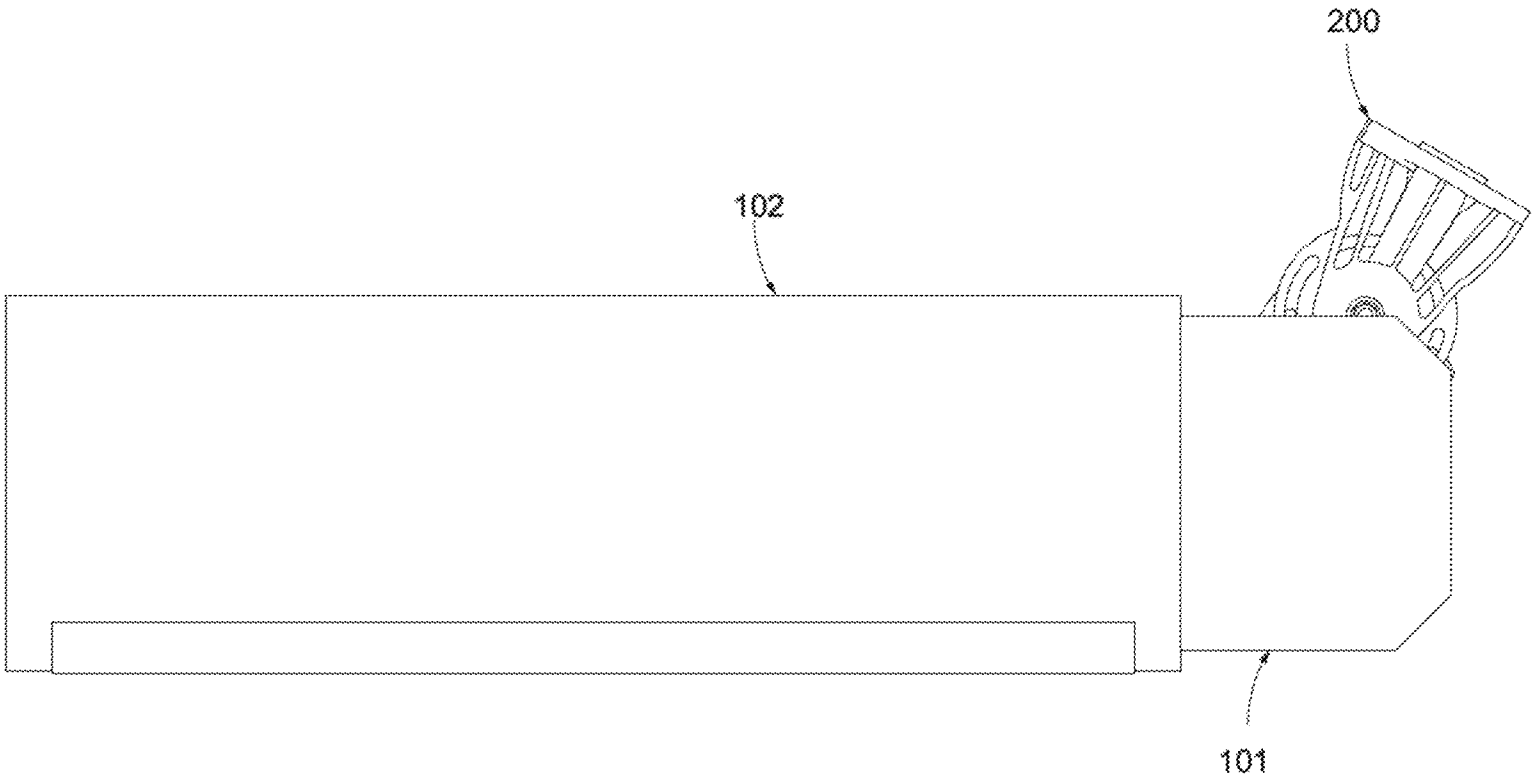
Figure 10:
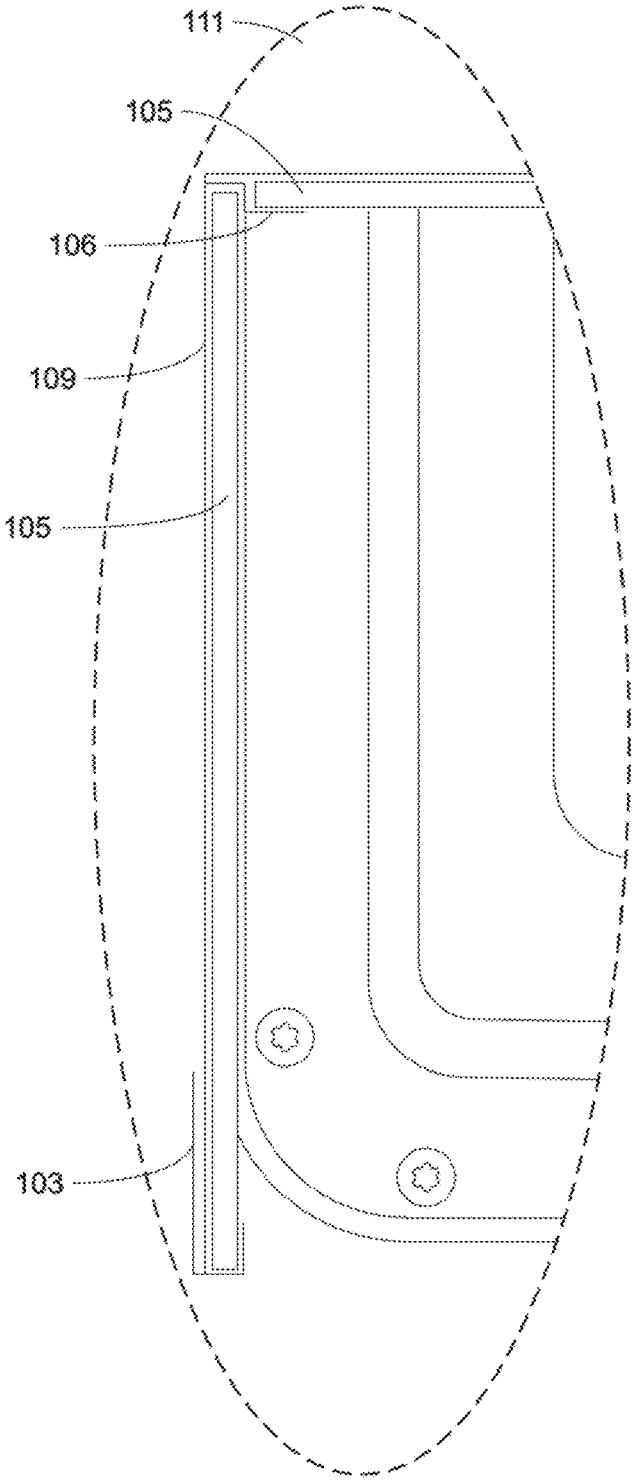

With regards to the multi-part differential reflection system, testing showed that producing differential reflection where one or more materials could be used in combination to provide a horizontal beam up to around 20 degrees from photometric center (i.e., up to a 60 degree horizontal beam spread) could be achieved, and could be achieved with the least perceived glare and best beam properties when using materials that produced specular reflection (which was unexpected). That being said, for some high demand lighting applications glare may still be perceived due to direct viewing of the light sources (even if only viewed in one's periphery). In these situations, step 9003 may comprise adding additional devices in the impacted plane; see, for example, FIG. 4. Here LEDs 1005A (FIG. 3) were still visible from a driver's periphery at some turns in the racetrack evaluated; as such, a center device 1004,107 was added (with associated differential reflection materials) not necessary to provide horizontal beam containment or to smooth out the beam pattern, but to prevent the light sources from being directly seen. All of the aforementioned are valid considerations according to step 9003 of method 9000.

Figure 27B:
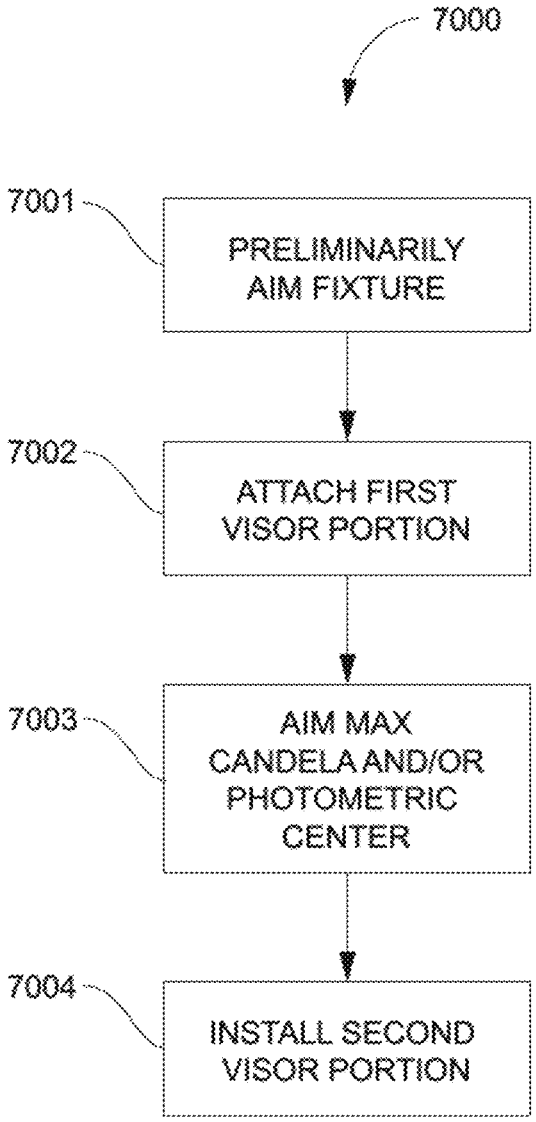

According to step 9004 the lighting system is installed at a site. The precise substeps of step 9004 will depend on the style and configuration of lighting fixture, and other considerations already discussed. One possible substep is illustrated in FIG. 27B; here, focusing in particular on the aiming of the multi-part visor. According to a first step 7001 of method 7000, the fixture is preliminarily aimed; here "fixture" could be any of Embodiments 1-4 without the multi-part visor. In fact, as can be seen from the figures and discussion set forth below, all of the embodiments rely on the same fixture housing 1003, 1004, 1007, 1006 and adjustable armature 200 (see, e.g., FIGS. 1, 3 and 16). By relying on the same fixture housing, crossarm spacings and thermal capacity, for example, can be standardized across applications to reduce cost and increase ease of design/installation—though this could differ and not depart from aspects of the present invention. According to step 7001, preliminary aiming generally comprises mounting a fixture (without visor) at its mounting location and aiming the fixture housing in both vertical and horizontal planes generally towards the target area so that lower beam edges are placed at the desired locations (see, e.g., reference nos. 408, FIG. 13A and 702, FIG. 25); this allows for a rough, or preliminary, aiming.

According to a second step 7002, the first visor portion is affixed to the roughly aimed LED lighting fixture housing. This can be an important step because attaching the first visor portion will typically reveal any problems in the lighting design—for example, fixtures photometrically or physically interfering with one another because of poor aiming or incorrect selection of visor length. Assuming all is generally acceptable according to step 7002, a third step 7003 comprises aiming the maximum candela and/or photometric center point to a desired point at the target area; again, this is a deviation from conventional wisdom as the fixture is not entirely installed at this point. Returning again to the racetrack example of FIG. 13A, the maximum candela point (as determined onsite or by photometry in lighting design software) would be aimed just short of the race car—so to ensure adequate modeling of the car, ensure adequate light levels, and highlight advertisements on the car—and would involve tilting the lighting fixture slightly upward (i.e., away from the target area). A last step 7004 comprises adding the second visor portion (e.g., at the distal point of the first visor portion, remote from the first visor portion, remote from the first portion but structurally connected) to establish sharp cutoff in the desired plane and establish final aiming. Method 7000 is but one possible substep/submethod of step 9004 of method 9000.

Figure 28:
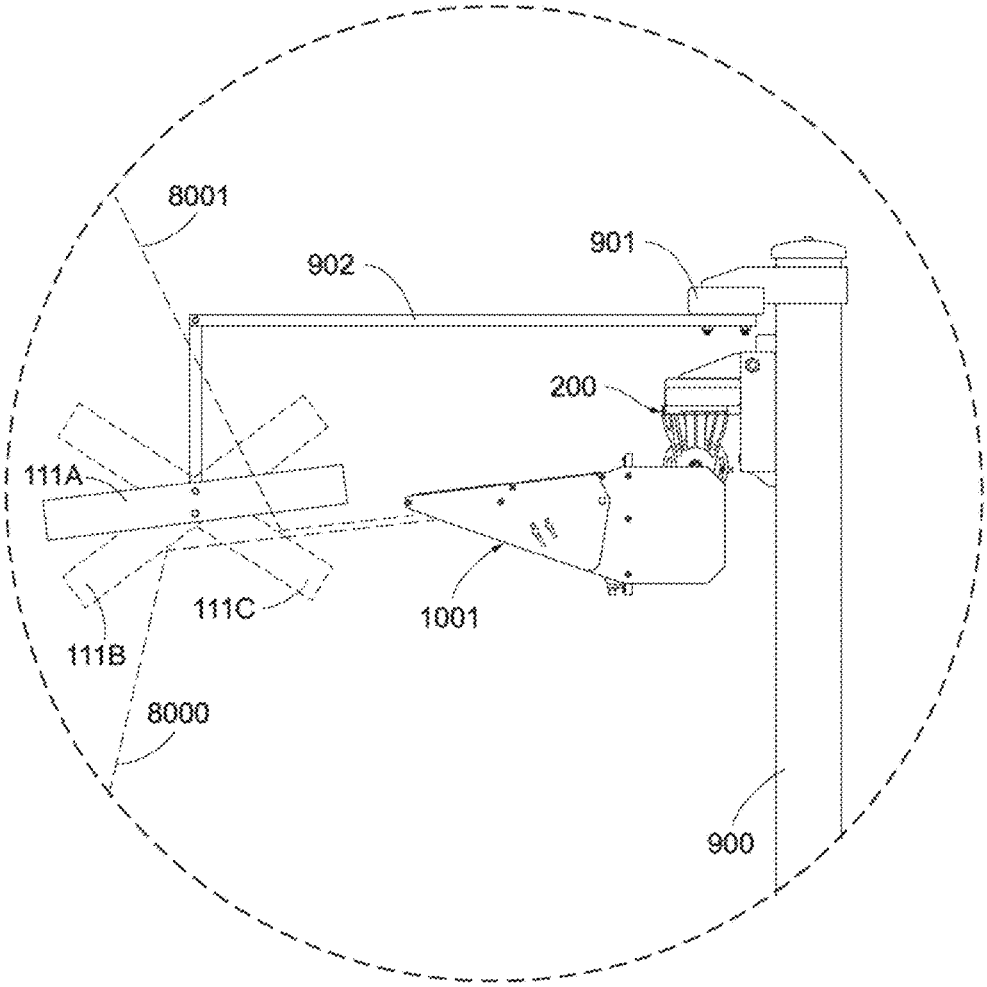
FIG. 28 illustrates an alternative approach to locating the second visor portion relative the first visor portion at Detail D of FIG. 25; here, not attached to the first portion (i.e., they are capable of moving independently) yet still structurally connected to the first portion (i.e., not remotely located as in Embodiments 2 and 4).
Figure 29:
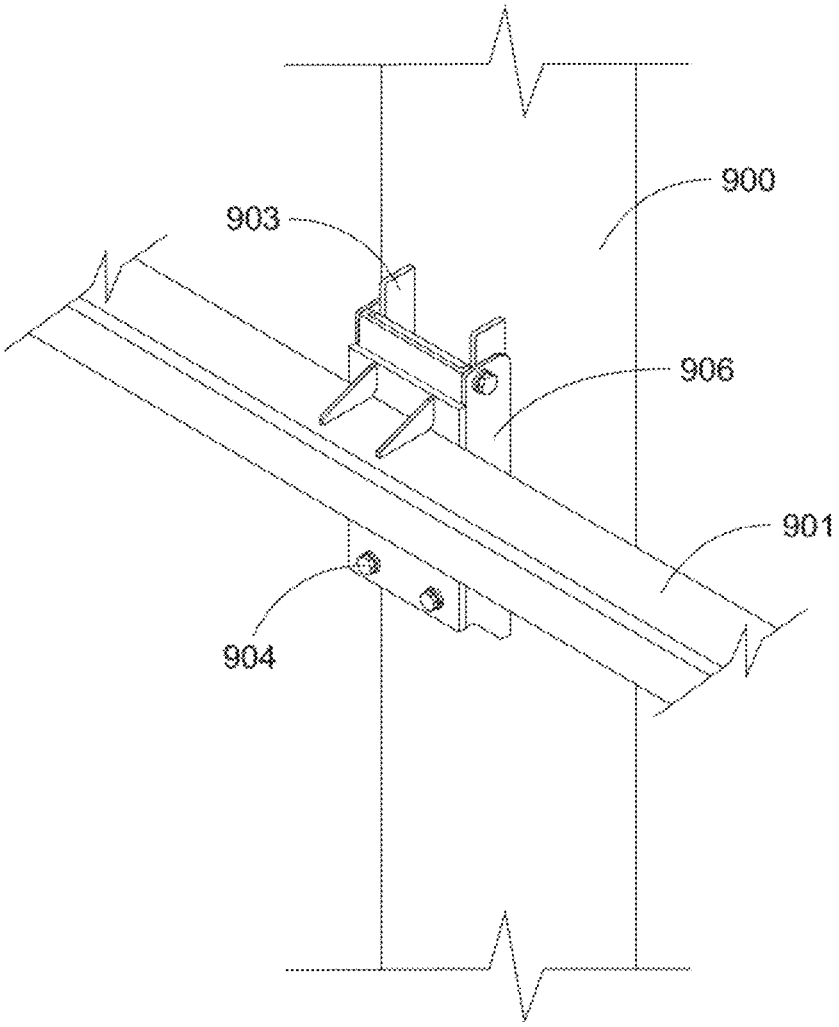
FIG. 29 illustrates one possible device for attaching the apparatus of FIG. 28 to a pole or other elevating structure.

According to step 9005 vertical and horizontal cutoff may are confirmed. If inadequate (e.g., vertical cutoff is not sharp enough), the entire fixture can be re-aimed (see method 7000) or portions thereof fine-tuned. One possible option is to provide structure to pivot the second portion of the multi-purpose visoring system only—this can be quite useful in step 9005 to push cutoff inches in either direction in a single plane only. In such circumstances, second visor portion 111 (see, e.g., FIG. 13A) may be located near the rest of fixture 100/1000 (depending on the embodiment), and structurally connected to but not directly affixed to other portions of the multi-part visoring system; this is illustrated in FIG. 28 for the five-pole baseball layout of FIG. 25. As can be seen, in an un-pivoted or slightly pivoted state, second visor portion 111A—which is affixed to a pole 900 via crossarm 901 and support structure 902—might be blackened and light absorbing and provide sharp cutoff as has already been described. If pivoted upward and a bottom surface made reflective, second visor portion 111B could direct some light (diagrammatically depicted at reference no. 8000) downwardly so to (i) improve light that is useful for the application (e.g., improve target efficacy rating (TER)), and (ii) light difficult-to-light portions of the target area. Alternatively, if pivoted downward and a top surface made reflective, second visor portion 111C could direct some light (diagrammatically depicted at reference no. 8001) upward to provide uplight. In any of the aforementioned visor portion 111 could be affixed to pole 900 via a support structure 902 and crossarm 901 which is further interfaced with a commercially available bracketing system such as that illustrated in FIG. 29 (which generally comprises first and second bracket holders 903/906 with fastening devices 904).

Specific exemplary embodiments, utilizing aspects of the multi-part components described above, will now be described. Generally speaking, each embodiment has the geometric center of its fixture, the photometric center of each fixture's respective beam pattern, and the maximum candela of each fixture's respective beam pattern colocated—this greatly simplifies discussion (and lighting design), though this could differ and not depart from aspects according to the present invention.

B. Exemplary Embodiment 1

FIGS. 1-10 illustrate a first embodiment which may be best suited for difficult lighting applications such as the aforementioned irregular racetracks; though this is by way of example and not by way of limitation. Generally speaking, fixture 100 comprises an external light redirecting portion 102 which includes aspects of the multi-part differential reflection and/or multi-part visoring systems, a housing with internal components 101 which includes aspects of the multi-part optic system, and an adjustable armature 200 for affixing such to a crossarm, pole, or other elevating structure (not illustrated); adjustable armature 200 may be similar in design to that described in aforementioned U.S. patent application Ser. No. 12/910,443 (now published US 2011/0149592), or otherwise.

Figure 2:
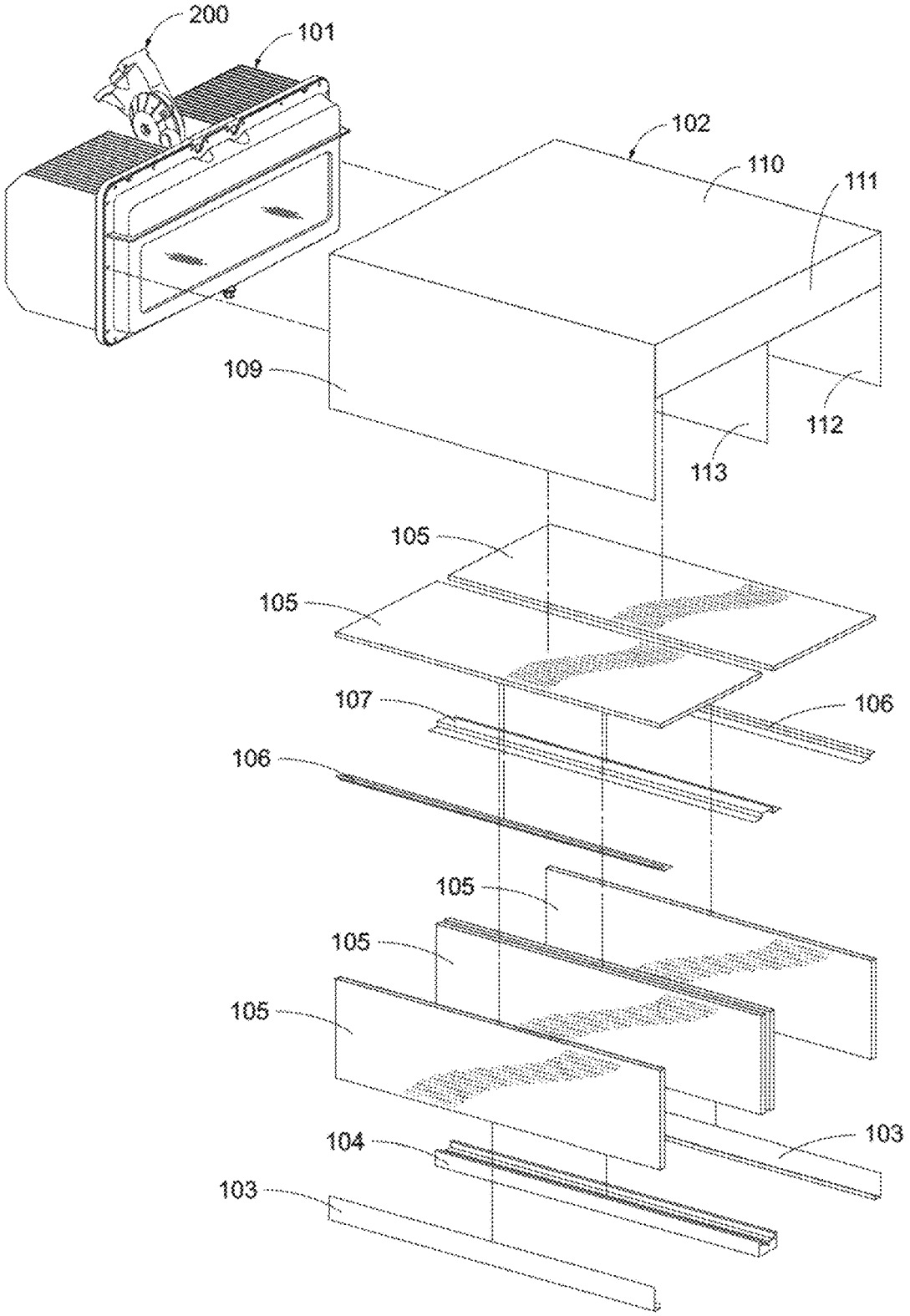

FIG. 2 illustrates in greater detail components of external light redirection portion 102. A generally rigid housing having a exterior top 110 and exterior sides 109 support one or more pieces of glass or other transmissive/transparent materials that have been coated, treated, or simply stacked so to provide the desired degree of differential reflection (previously discussed); if desired, outside center 112 and inside center 113 surfaces could be coated so to provide a particular degree of reflection (e.g., Anolux-Miro® coating available from Anomet, Inc., Brampton, Ontario, Canada) or absorption (e.g., black paint). Differential reflection materials 105 are easily slid in and out of channels formed by channel rails 103, 104, 106, and 107; channel rails can be bolted, welded, glued, or otherwise affixed to top 110 and exterior sides 109 or to other portions of fixture 100 such as housing portion 101. In practice, it is preferred if there is no gap between the light emitting face of housing portion 101 (i.e., at glass 1003) and external light redirection portion 102 as any such gap may allow the escape of light above the fixture which (i) could strike an upper fixture or pole (assuming an array of fixtures) and cause glare, or (ii) simply be wasted.

The multi-part visoring system includes one or more differential reflection materials 105 on the inside of top 110—which could be black glass, reflective coating on aluminum (see aforementioned Anolux-Miro® coating), or otherwise (see previous discussion)—in combination with the aforementioned second visor portion (reference no. 111) which is blackened or otherwise light absorbing. As designed, second visor portion 111 has a length spanning that of the horizontal dimension of the fixture (see FIG. 4) with a height extending some distance down into the composite beam projected from the face of front housing 1004 (i.e., the emitting face) so to achieve a desired aforementioned sharp cutoff, and is, (i) perpendicular to said first visor portion, and (ii) some distance away from said LEDs; though as was discussed, the second visor portion could be other than perpendicular to the first visor portion (e.g., via pivoting).

FIG. 3 illustrates in greater detail the lighting fixture housing 1004/1003/1007/1006 with internal components 101 exploded. A plurality of heat fins 1006 is bolted welded, or otherwise affixed to a back surface of a back housing portion 1007; LEDs 1005A are directly affixed to an inner surface of back housing portion 1007 (to aid in thermal dissipation). Front housing 1004 is bolted or otherwise affixed to back housing 1007 so to collectively define an internal space for LEDs 1005A and the multi-part optic system 1005B/C (previously discussed), along with any sealing devices, electrical connections, etc. (not illustrated).

C. Exemplary Embodiment 2

Figure 11:
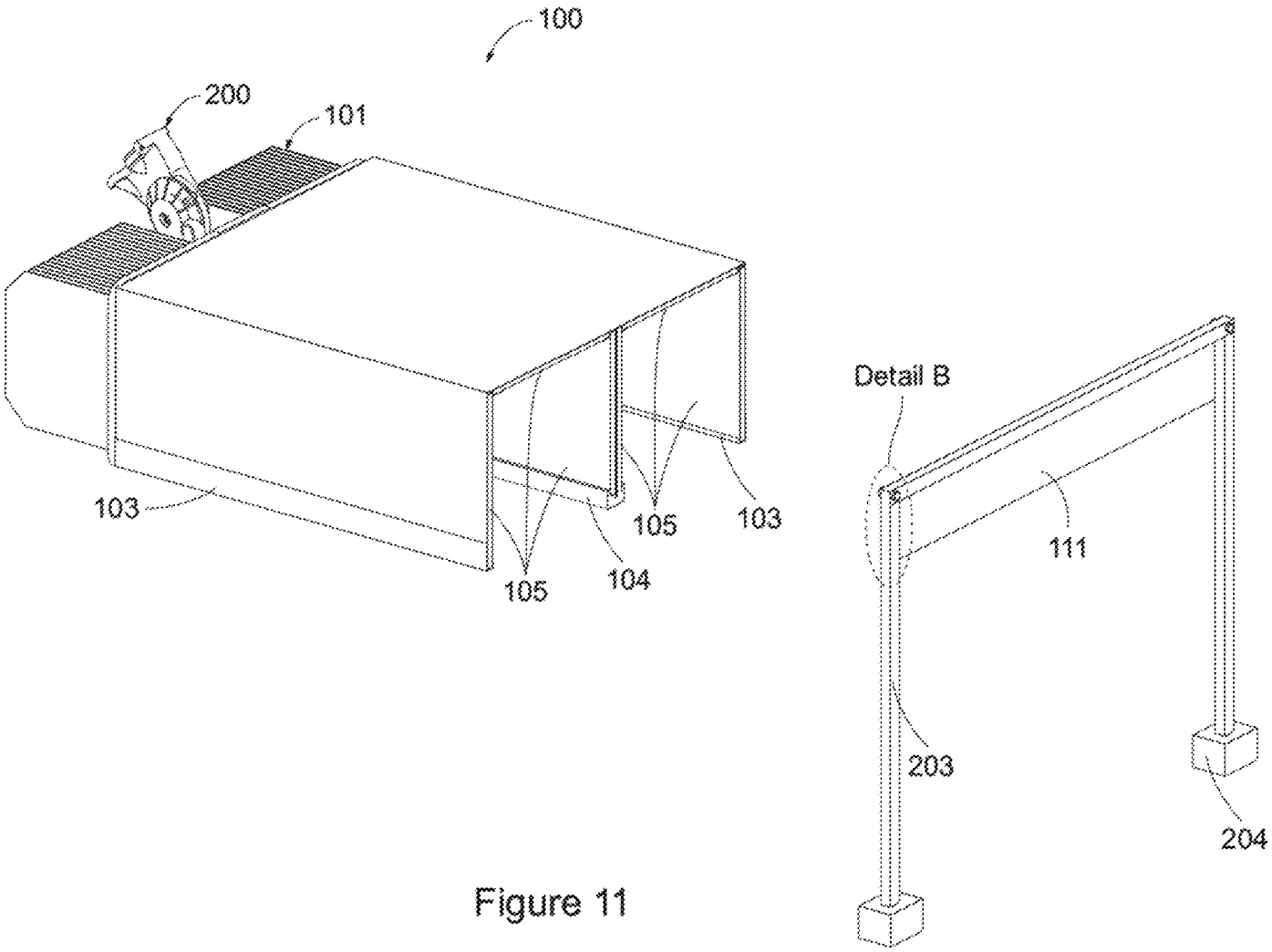
Figure 12:
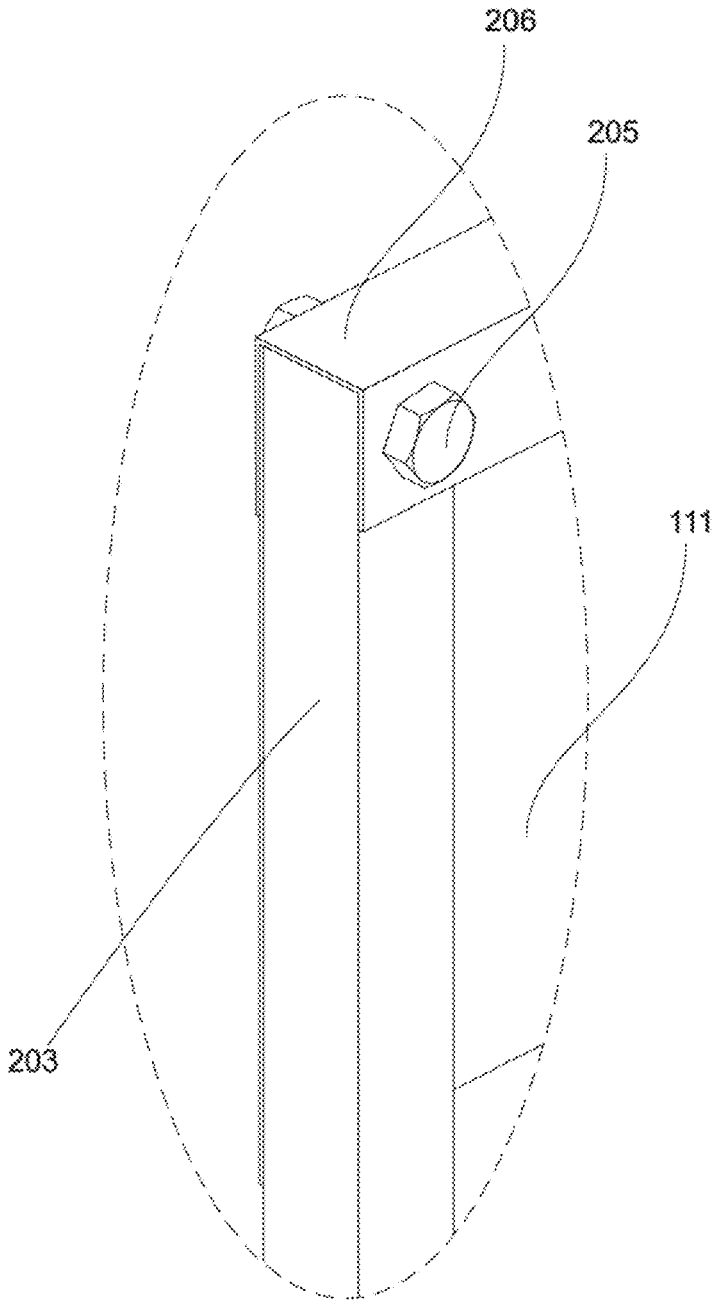

In some situations, there is adequate fixture setback to permit locating the second portion of the multi-part visoring system remote from the first portion; the benefit to doing so is reducing the amount of light which must be absorbed to provide the sharp cutoff, thereby reducing light loss and preserving fixture efficiency. In this alternative embodiment (see FIGS. 11 and 12) said second visor portion 111 is located some distance away from the rest of fixture 100 (e.g., several feet) and mounted to a base 204 by bolting 205 or otherwise affixing a bracket 206 to a post or other elevating structure 203 which is integral to or affixed to base 204, said bracket 206 adapted to grip and provide rigidity to second visor portion 111.

D. Exemplary Embodiment 3

In some situations, the lighting fixture is elevated significantly higher than the target area (e.g., dozens of feet) and so more severe aiming angles are needed to adequately illuminate the target area—as in five-pole baseball layouts. As such, an alternative embodiment for such a purpose (though not limited to such) is illustrated in FIGS. 14-22. According to the present embodiment the same housing with internal components 101 and adjustable armature 200 (not illustrated) is used as in Embodiments 1 and 2; however, external light redirection portion 1001 actually includes a third visor portion. Similar to principles discussed in U.S. Patent Publication No. 2013/0250556, issued as U.S. Pat. No. 9,631,795 on Apr. 25, 2017 and incorporated by reference herein in its entirety, if desired the multi-part visoring system may include a first fixed reflective visor portion 1010, a first adjustable reflective visor portion 1009, and aforementioned second light absorbing portion 111. First fixed visor portion 1010 and first adjustable visor portion 1009 collectively form the aforementioned first portion of the multi-visor system insomuch that a proximate end 1011 generally abuts front housing portion 1004 and a distal end 1012 is located nearest the second visor portion (which in this embodiment is attached to side 1021 and pivots with it). Rigidity and pivoting functionality is provided by sides 1020, 1021 in combination with fastening devices/pivoting mechanism 1008—which is described in greater detail in aforementioned U.S. Patent Publication No. 2013/0250556 (now U.S. Pat. No. 9,631,795). Given the more severe aiming angles of fixture 1000 (see, for example, FIG. 25), differential reflection materials 105 will likely be unable to be secured using a rail system. Rather, materials 105 (if glass or similar material) would likely be affixed in place using a combination of bored hole(s), rubber grommet(s) 108, and fastening device(s) (e.g., screws—not illustrated in FIG. 15); otherwise, materials 105 (if aluminum sheet) could potentially be glued in place (e.g., so to avoid bending the material when bolting in place and inadvertently modifying the beam properties).

E. Exemplary Embodiment 4

Figure 23:
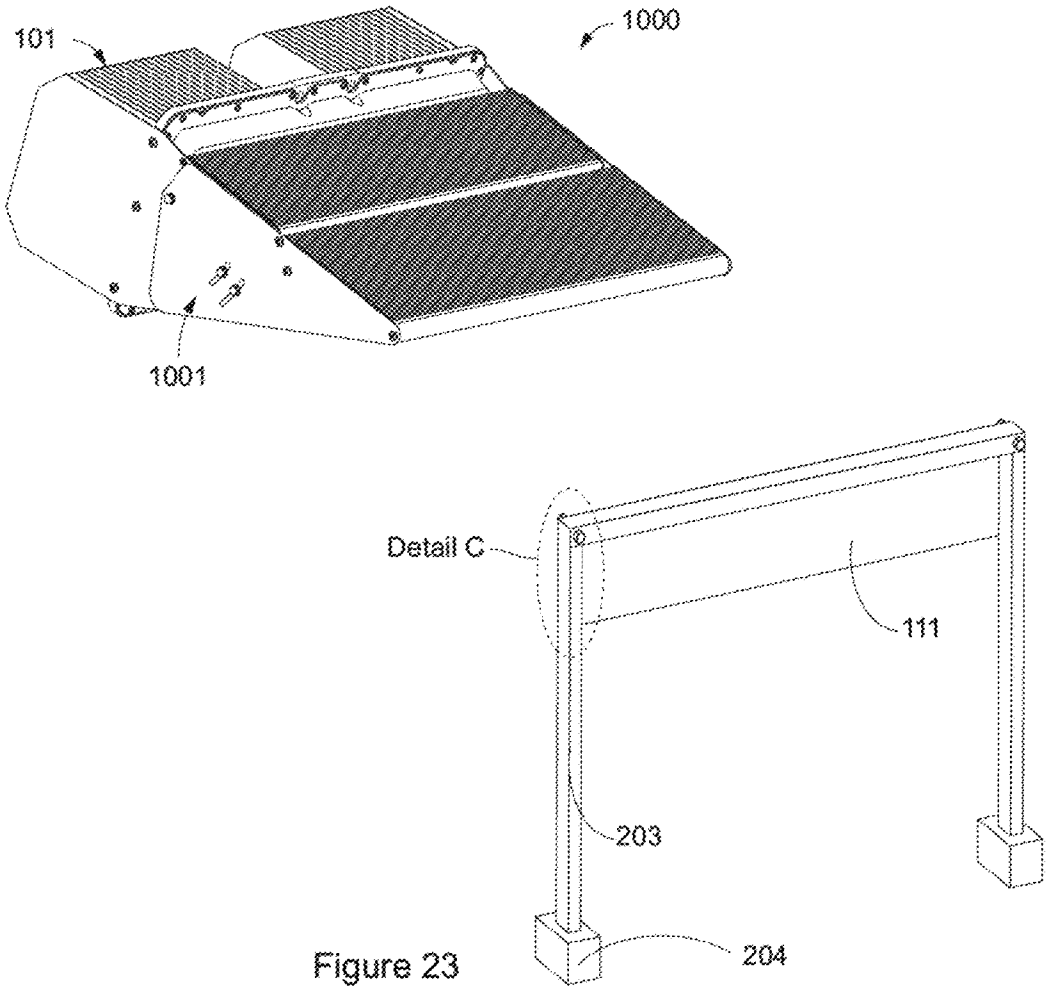
Figure 24:
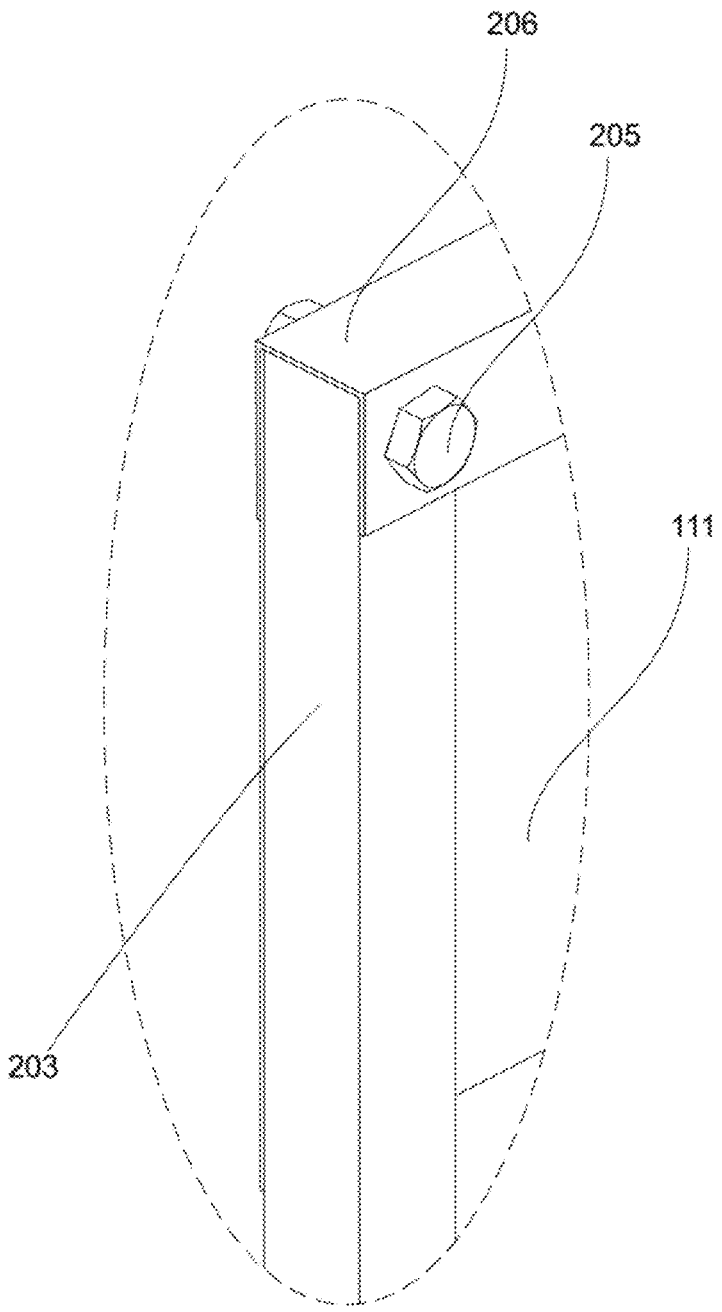

As previously discussed, in some situations there is adequate fixture setback to permit locating the second portion of the multi-part visoring system remote from the first portion; the benefit to doing so is reducing the amount of light which must be absorbed to provide the sharp cutoff, thereby reducing light loss and preserving fixture efficiency. In this alternative embodiment (see FIGS. 23 and 24) said second visor portion 111 is located some distance away from the rest of fixture 1000 (e.g., several feet) and mounted to a base 204 by bolting 205 or otherwise affixing a bracket 206 to a post or other elevating structure 203 which is integral to or affixed to base 204, said bracket 206 adapted to grip and provide rigidity to second visor portion 111.

F. Options and Alternatives

The invention may take many forms and embodiments. The foregoing examples are but a few of those. To give some sense of some options and alternatives, a few examples are given below.

Discussed herein are multiple embodiments including a variety of combinations of first and second visor portions, narrow beam and wide beam lenses, and varying materials that could be layered to provide differential reflection; a variety of permutations (including use of any of the multi-part devices in isolation) is possible, and envisioned. As one example, independent pivoting of the secondary visor portion has been discussed (see FIG. 28); however, a similar effect could be achieved by stationary secondary visor portions which are angled relative to first visor portions (instead of being perpendicular). As another example, an array of LEDs could include multiple rows of LEDs (as in FIG. 13B) but may include only a single row to ensure sharper cutoff (as in FIGS. 13A and 28). Likewise, secondary lenses integrally formed in secondary lens sheet 1005C (e.g., FIGS. 3 and 16) could each encapsulate a single LED, multiple LEDs (e.g., RGB-type dies or multiple single dies), or within a fixture or a strip of sheet 1005C some lenses encapsulate single LEDs while others encapsulate multiple LEDs.

Further, a variety of materials, processing means, finishes, and material compositions could be used in any of the devices and components discussed herein; it is important to note those described and illustrated in Embodiments 1-4 are by way of example and not by way of limitation. For example, a precision lighting fixture according to aspects of the present invention might include multiple laser diodes instead of multiple LEDs as the light source. As another example, a precision lighting fixture might include a multi-part differential reflection system wherein one or more differential reflection materials 105 has a unique set of properties not reflected in Table 1; for example, an aluminum strip having a first half proximate the light sources blackened but the second distal half not at all blackened.

Finally, in terms of method 9000 it too is important to note that a variety of permutations is possible, and envisioned. Method 9000 may include fewer or additional steps; for an example of the latter, a step including preliminary beam adjustment via third axis aiming (e.g., via rotation of elliptical secondary lenses or armatures such as is discussed in aforementioned U.S. Pat. No. 8,789,967 which is incorporated by reference herein in its entirety). Method 9000 might include more, fewer, or different substeps; for an example of the former, if a lighting designer is considering using multiple rows of lighting fixtures on multiple crossarms at a single pole location, step 9002 may need to also take into consideration potential photometric interference between lighting fixtures installed on different rows. Consideration of such may yield additional considerations or substeps in step 9003; for example, the need to blacken exterior portions of lighting fixtures lower in the array (i.e., at a lower crossarm position) to absorb stray light which may strike it from a lighting fixture higher in the array (i.e., at a higher crossarm position).

What is claimed is:

1. An LED lighting fixture comprising:

a. a lighting fixture housing having an emitting face defined by an opening in the lighting fixture housing into an internal space in the lighting fixture housing;

b. a thermally conductive surface in the internal space in the lighting fixture housing;

c. a plurality of LEDs mounted to the thermally conductive surface in the internal space in the lighting fixture housing, each LED having a beam output;

d. a silicone secondary lens device having a plurality of integrally formed secondary lenses each of which encapsulates one or more of the LEDs mounted to the thermally conductive surface in the internal space in the lighting fixture housing and a plurality of apertures; and e. a secondary lens holder having a plurality of pegs inserted through the plurality of apertures in the silicone secondary lens device and heat staked in situ to resiliently hold the silicone secondary lens device in a position that prevents distortion of the LED beam outputs when the silicone secondary lens device thermally expands and contracts.

2. The LED lighting fixture of claim 1 wherein the silicone secondary lens device comprises a sheet of silicone having a plurality of integrally formed secondary lenses.

3. The LED lighting fixture of claim 2 wherein the plurality of integrally formed secondary lenses in the silicone secondary lenses sheet includes at least two different beam types.

4. The LED lighting fixture of claim 1 further comprising a multi-part visoring system having a first portion and second portion and wherein:

a. the first portion is installed outside the lighting fixture housing and proximate the emitting face of the lighting fixture housing such that a reflective surface of the first portion redirects the beam output from one or more of the plurality of LEDs; and b. the second portion is installed outside the lighting fixture housing remote from the emitting face of the lighting fixture housing such that a light absorbing surface of the second portion cuts off the beam output from one or more of the plurality of LEDs.

5. The LED lighting fixture of claim 4 wherein the second visor portion is attached to the first visor portion.

6. The LED lighting fixture of claim 4 wherein the second visor portion is not attached to the first visor portion or the lighting fixture housing and is located some distance away from the lighting fixture housing.

7. The LED lighting fixture of claim 6 wherein the second visor portion is attached to a portion of an elevating structure common to the lighting fixture housing, and wherein the second visor portion is pivotable independently from the first visor portion via a pivoting mechanism.

8. The LED lighting fixture of claim 1 further comprising a multi-part differential reflection system installed outside the lighting fixture housing and proximate the emitting face of the lighting fixture housing and comprising:

a. one or more differential reflection materials; and b. one or more fastening devices to secure the one or more differential reflection materials in a desired plane relative the emitting face of the lighting fixture housing.

9. The LED lighting fixture of claim 8 wherein the differential reflection materials of the multi-part differential reflection system comprise one or more of:

a. aluminum sheet;

b. aluminum sheet with a reflective coating;

c. aluminum sheet with a light absorbing coating;

d. glass;

e. glass with a reflective coating on a back surface;

f. glass with an anti-reflective coating on a back surface; or g. glass with a light absorbing coating on a back surface.

10. The LED lighting fixture of claim 8 wherein the one or more fastening devices to secure the one or more differential reflection materials comprises one or more of:

a. channel rails;

b. rubber grommets with associated screws; or c. glue.

11. A method of illuminating high demand or difficult to illuminate sites with an array of light fixtures each including a plurality of LED light sources mounted to an inner surface of the light fixtures comprising:

a. evaluating lighting needs for the site including one or more of:

i. light uniformity;

ii. light intensity;

iii. spill light;

iv. glare light;

b. evaluating site restrictions relating to one or more of:

i. lighting fixture placement relative the site to be illuminated;

ii. the site to be illuminated;

iii. spectators or bystanders;

c. addressing the lighting needs for the site and the site restrictions by:
   i. tailoring a composite beam dimensions by directing light at or near the light sources of the fixture consistent with lighting needs and site restrictions via:
      1. an optic comprising one or more strips of silicone sheets each sheet having integrally formed secondary lenses having tailored beam dimensions and each secondary lens encapsulating one or more of the light sources; and
      2. an optic holder comprising a rigid portion abutting the secondary lenses of the optic and having a fill material such that the optic holder matches a specified thermal expansion of the inner surface of the light fixtures;
   ii. cutting off the composite beam in a first plane to promote sharper and/or steeper cutoff of the light sources from the light fixture consistent with lighting needs and site restrictions and deter beam shift; and
   iii. redirecting some of the composite beam in a second plane by second surface mirror technique to promote light uniformity and intensity consistent with lighting needs and site restrictions.

12. The method of claim 11 further comprising redirecting some of the composite beam in the first plane via a multi-part light redirecting components comprising:
a. a first stage nearer the light sources configured to promote maximum candela or photometric center at a desired location at the site; and
b. a second stage farther from the light sources to control beam cutoff and shape from the light sources.

13. The method of claim 12 wherein the second stage is one of:
a. structurally connected to the first stage;
b. separated from the first stage.

14. The method of claim 12 wherein the redirecting of at least some of the composite beam in the first plane uses multi-part differential reflection comprising:
a. one or more surfaces configured to operate as second surface mirrors to avoid beam shifting and lower glare from the light sources.

15. The method of claim 14 wherein each of the one or more surfaces configured to operate as second surface mirrors comprises one or more of:
a. a coating;
b. paint;
c. a processed material.

16. A system for illuminating sites comprising:
a. an array of light fixtures, each light fixture of the array comprising a plurality of LED light sources in a fixture housing having a light emitting opening at or near the light sources;
b. one or more of the light fixtures comprising:
   i. multi-part light directing components at the light sources comprising;
      1. a single piece secondary lens device with integral secondary lenses;
      2. a single piece secondary lens device holder for holding the single piece secondary lens device in alignment with the light sources and deterring distortion of its shape during operation of the light sources;
   ii. multi-part visor components away from the light sources comprising:
      1. a first stage nearer the light sources configured to promote maximum candela or photometric center at a desired location at the site;
      2. a second stage farther from the light sources to control beam cutoff and shape from the light sources;
   iii. multi-part differential reflection components at the multi-part visor components comprising:
      1. surfaces that act as second surface reflectors;
      2. at or around the multi-part visor components; and
   iv. multi-part differential reflection components at the light emitting opening of the fixture housing near the single piece secondary lens device with single piece secondary lens device holder such that:
      1. a subset of light sources are on a first side of the multi-part differential reflection components;
      2. a subset of light sources are on a second side of the multi-part differential reflection components;
      3. the first and second sides of the multi-part differential reflection components are in a same plane; and
      4. the light sources cannot be directly viewed in the plane from one or more specified view points at the sites.

17. The system of claim 16 wherein the multi-part light directing components are near the light emitting opening of the fixture housing for a compact fixture housing.

18. The system of claim 16 wherein the multi-part light directing components are heat staked to a substrate to which the light sources are mounted.

* * * * *